US010557262B2

(12) United States Patent
Moran et al.

(10) Patent No.: US 10,557,262 B2
(45) **Date of Patent: *Feb. 11, 2020**

(54) MODULAR PANELS AND RELATED ELEMENTS TO FORM A VARIETY OF WALL SEGMENTS AND ENCLOSURES

(71) Applicant: MCCAIN MANUFACTURING, INC., Vista, CA (US)

(72) Inventors: Thomas Moran, Vista, CA (US); Stephany Lugardo, Vista, CA (US); Donald Martin Engh, Vista, CA (US)

(73) Assignee: McCain Manufacturing, Inc., Vista, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/124,097

(22) Filed: Sep. 6, 2018

(65) Prior Publication Data

US 2019/0010691 A1 Jan. 10, 2019

Related U.S. Application Data

(63) Continuation-in-part of application No. 15/625,156, filed on Jun. 16, 2017, now Pat. No. 10,072,411.

(51) Int. Cl.

| | |
|---|---|
| ***E04B 1/343*** | (2006.01) |
| ***E04B 1/348*** | (2006.01) |
| ***E04B 1/61*** | (2006.01) |
| ***E04H 1/12*** | (2006.01) |
| ***E04B 2/74*** | (2006.01) |

(52) U.S. Cl.

CPC ..... *E04B 1/3483* (2013.01); *E04B 1/34321* (2013.01); *E04B 1/61* (2013.01); *E04B 2/7416* (2013.01); *E04H 1/125* (2013.01); *E04B 2001/34892* (2013.01); *E04B 2001/6195* (2013.01); *E04H 1/1272* (2013.01)

(58) Field of Classification Search

CPC .... E04B 1/3483; E04B 2/7401; E04B 2/7416; E04B 1/61; E04B 1/34321; E04B 2002/7481; E04B 2001/6195; E04B 2001/34892; E04H 1/125; E04H 1/1272

USPC ..... 52/91.1, 300, 506.01

See application file for complete search history.

(56) References Cited

U.S. PATENT DOCUMENTS

| | | | |
|---|---|---|---|
| 817,508 | A | 4/1906 | Niele |
| 1,229,478 | A | 6/1917 | Kramer |
| 2,023,814 | A | 12/1935 | Lindsey |
| 2,365,175 | A | 12/1944 | Crawford |
| 3,031,044 | A | 4/1962 | Stitt et al. |
| 3,195,735 | A | 7/1965 | Jay |
| 3,353,318 | A | 11/1967 | Bacher |

(Continued)

FOREIGN PATENT DOCUMENTS

| | | | |
|---|---|---|---|
| EP | 611853 | A1 | 8/1994 |

*Primary Examiner* — Brent W Herring

(74) *Attorney, Agent, or Firm* — The Maxham Firm; Lawrence A. Maxham

(57) ABSTRACT

A modular panel and component system from which a variety of wall segments, wall structures, and enclosures may be rapidly assembled, and disassembled. In addition to the wall panels, interior finish panels may be included which are adapted to be hung from rails secured to the inside of adjacent wall panels. The system may also include door assemblies or window assemblies, or both, and ancillary brackets and hardware to facilitate the assembly of the contemplated wall structures and enclosures.

13 Claims, 35 Drawing Sheets

(56) References Cited

U.S. PATENT DOCUMENTS

| | | | | |
|---|---|---|---|---|
| 3,568,388 | A | 3/1971 | Flachbarth et al. | |
| 3,657,849 | A | 4/1972 | Garton | |
| 3,755,975 | A | 9/1973 | Herzer et al. | |
| 3,777,430 | A | 12/1973 | Tischuk | |
| 3,996,712 | A | 12/1976 | Howell | |
| 4,099,021 | A | 7/1978 | Venezia | |
| 4,165,944 | A | 8/1979 | Sunasky | |
| 4,221,087 | A | 9/1980 | Lowe | |
| 4,267,679 | A | 5/1981 | Thompson | |
| 4,291,510 | A | 9/1981 | Sivachenko | |
| 4,438,614 | A * | 3/1984 | Raith | E04B 2/7401 52/481.2 |
| 4,561,233 | A | 12/1985 | Harter et al. | |
| 4,712,336 | A | 12/1987 | Backer | |
| 5,522,194 | A * | 6/1996 | Graulich | E04O 2/26 52/309.12 |
| 5,526,628 | A | 6/1996 | Knudson | |
| 6,076,308 | A | 6/2000 | Lyon et al. | |
| 6,145,263 | A | 11/2000 | Eckerd | |
| 6,698,710 | B1 * | 3/2004 | VanderWerf | E02D 27/02 249/159 |
| 6,834,468 | B1 | 12/2004 | Kroie | |
| 6,889,475 | B2 | 5/2005 | De Zen | |
| 6,901,708 | B1 | 6/2005 | Powers, III | |
| 7,356,970 | B1 | 4/2008 | Frobosilo | |
| 7,603,821 | B2 | 10/2009 | Eberlein et al. | |
| 7,818,932 | B2 | 10/2010 | Eberlein et al. | |
| 8,677,708 | B2 | 3/2014 | Williams | |
| 8,925,255 | B1 | 1/2015 | Haun et al. | |
| 8,973,337 | B2 | 3/2015 | Hires et al. | |
| 9,383,174 | B2 | 7/2016 | Phillips et al. | |
| 9,567,764 | B2 | 2/2017 | Phillips et al. | |
| 10,072,411 | B1 * | 9/2018 | Moran | E04B 2/7401 |
| 2002/0139072 | A1 * | 10/2002 | Laskowski | E04B 2/7457 52/245 |
| 2003/0182885 | A1 | 10/2003 | Gresham et al. | |
| 2006/0162268 | A1 | 7/2006 | Eberlein et al. | |
| 2010/0064597 | A1 | 3/2010 | Eberlein et al. | |
| 2014/0047795 | A1 * | 2/2014 | Hires | E04O 2/30 52/783.1 |
| 2014/0047995 | A1 | 2/2014 | Hires et al. | |
| 2015/0020468 | A1 | 1/2015 | Wickstrom | |

* cited by examiner

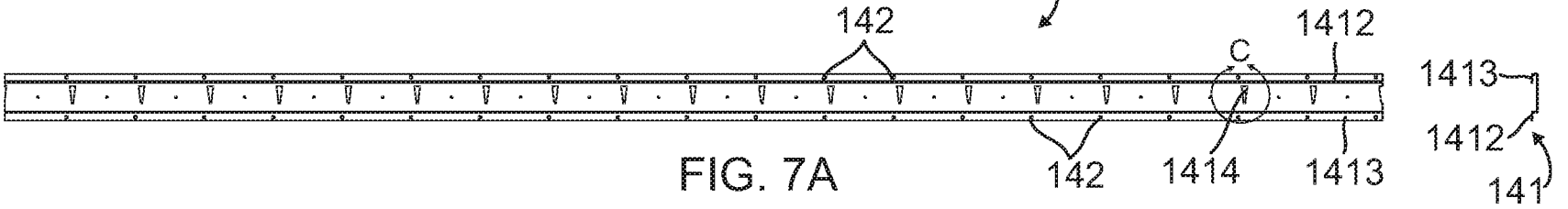
FIG. 7A
FIG. 7B
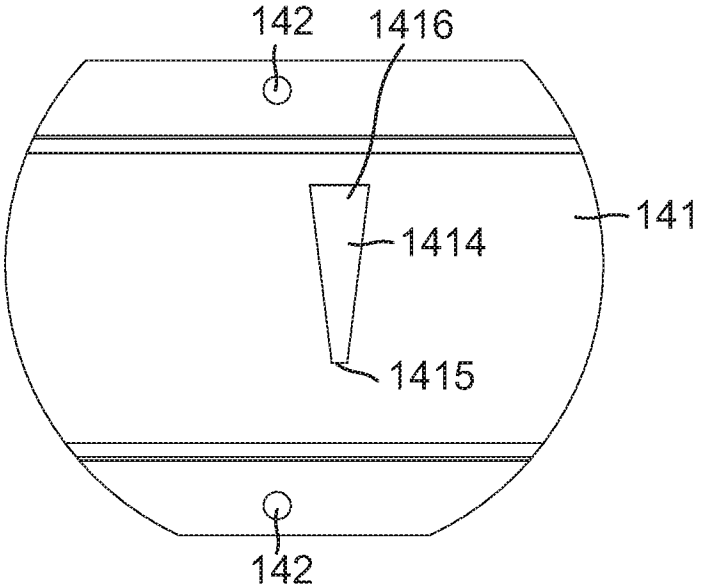
FIG. 7C

MODULAR PANELS AND RELATED ELEMENTS TO FORM A VARIETY OF WALL SEGMENTS AND ENCLOSURES

CROSS-REFERENCE TO RELATED APPLICATIONS

This is a continuation-in-part of application Ser. No. 15/625,156, filed 16 Jun. 2017, now U.S. Pat. No. 10,072,411, issued 11 Sep. 2018.

FIELD OF INVENTION

This concept relates generally to portable, assemblable, and disassemblable wall structures which can be selectively formed as walls and as enclosures, for both permanent and temporary purposes.

DISCUSSION OF THE PRIOR ART

Assemblable walls and enclosures are useful for many purposes. They can be used to form walls and enclosures for exhibits, and to form temporary and permanent walls and enclosures for a variety of other purposes. Examples of such other purposes include walls in pedestrian areas to separate construction apparatus and personnel from people passing along the same area. Enclosures can be for offices, for temporary storage of equipment and supplies, as well as for other activities. The possibilities for uses of modular walls and enclosures are vast and varied.

In the past, temporary walls were often constructed with drywall panels. These would take several days to construct and would be relatively heavy, non-recyclable, and messy in the assembly stages. Usually such drywall structures required some finish work and final painting.

An example of a modular kit to form walls and enclosures is the subject of U.S. Pat. No. 4,712,336, entitled INTERCONNECTING "FULL BLEED" MODULAR PANEL AND CONNECTIVE HARDWARE SYSTEM TO FORM A VARIETY OF EXHIBIT AND OFFICE INTERIOR ENCLOSURES. The wall panels and the mating connector elements enable modularity so that a variety of walls and structures can be constructed with the modular elements. Another modular building related publication is U.S. Pat. No. 5,526,628, entitled WALL, ROOF AND BUILDING STRUCTURES.

Generally, temporary wall and enclosure structures are not reusable and must be demolished and disposed of. This, of course, adds to the disruption that started with the initial construction, at least for drywall units. In addition to the building and subsequent removal of such structures, there is the concept of waste resulting from a single use, and the consequent landfill additions.

SUMMARY OF EMBODIMENTS OF THE INVENTION

The concepts described herein provide great flexibility and ease of assembly which can be accomplished in hours rather than days. Further, walls and enclosures constructed with this modular system can be disassembled and used again for another similar or completely different structure. Alternatively, a wall segment or whole enclosure so constructed can be moved in fully assembled form if desired.

Modular wall panels are secured together to form the length of wall that is needed for any particular purpose. Interior finish panels are formed with specifically designed hook elements which project away from the panels. Interior finish panel rails are secured horizontally across as many of the vertically oriented wall panels as necessary to accommodate the specified interior finish panels. Alternatively, vertical interior finish panel rails are secured vertically to the wall panels. The interior finish panel rails have specifically designed cutouts which are easily engaged by the panel hook elements in a manner that snugs the interior finish panels to the basic wall already constructed with a plurality of adjacent wall panels to provide a wall structure that is finished on both sides. The term "interior" as used here only refers to the side of the wall opposite to the outwardly facing wall panels, which would be within the interior of an enclosure formed by the components which comprise the wall system. Walls or enclosures so constructed may be located within a building or outside a building.

There are a number of optional and useful elements which can be included in order to provide for different location specifics, or to enhance the structure. For example, when a temporary wall is to abut a building wall, a starter panel can be employed, by which wall panels are connected to the building wall.

Bottom rails can be used on which the wall panels are mounted. Similarly, top rails can be used to enhance the stability of the tops of the wall panels as well as to provide an enhanced visual finish. The top and bottom rails can be identical. Where there needs to be two walls that are not planar, corner panels are used to provide the transition from one wall assembly to another, at an angle. That angle need not be 90°, although it would normally be at such a right angle. An embodiment with a curve instead of sharp angle is disclosed.

When necessary, door assemblies which comprise doors and wall panels can be configured to provide door access from one side of a wall to another. There could be single door or double door assemblies as they may be required for any structure specified. Similarly, window assemblies are disclosed.

Additionally, a top or ceiling arrangement can be employed with a wall or room structure.

The system includes appropriate hardware for various purposes, as will be described below. Because the system is modularized, all panel and other positive element connections can be accomplished with metal screws or equivalent elements.

BRIEF DESCRIPTION OF THE DRAWING

The objects, advantages, and features of this modular system will be readily perceived from the following detailed description, when read in conjunction with the accompanying drawing, in which:

FIG. 7A is a front view of a horizontal interior finish panel rail which is configured for use with the FIGS. 1 and 2 wall system embodiment;

FIG. 7B is an end view of the interior finish panel rail of FIG. 7A;

FIG. 7C is an enlarged view of a cutout in the rail of FIG. 7A;

DETAILED DESCRIPTION OF EMBODIMENTS OF THE INVENTION

Figure 1:
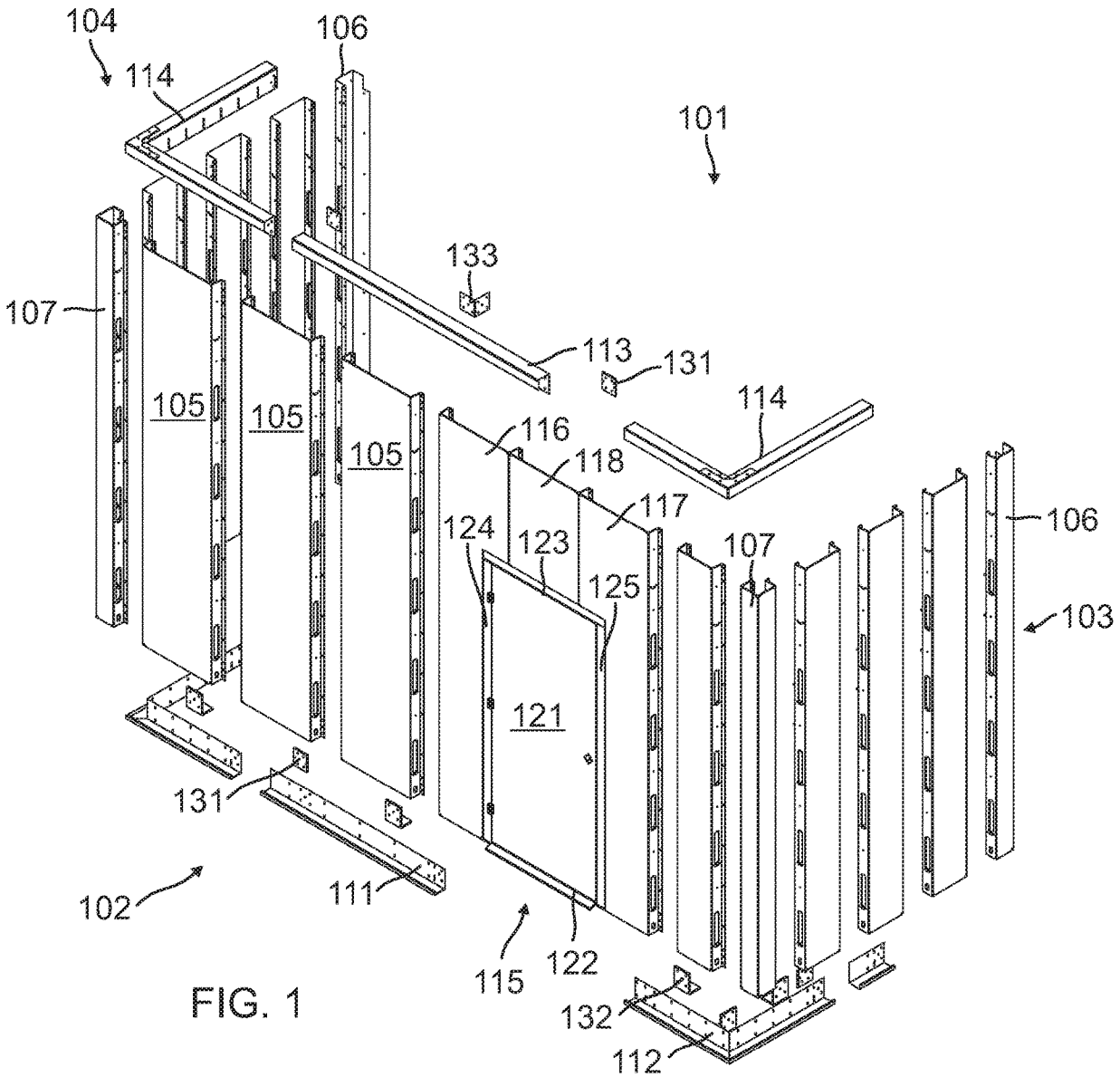
FIG. 1 is a perspective exploded view of component parts which make up a multi-panel wall configuration in accordance with an embodiment of this system.
Figure 2:
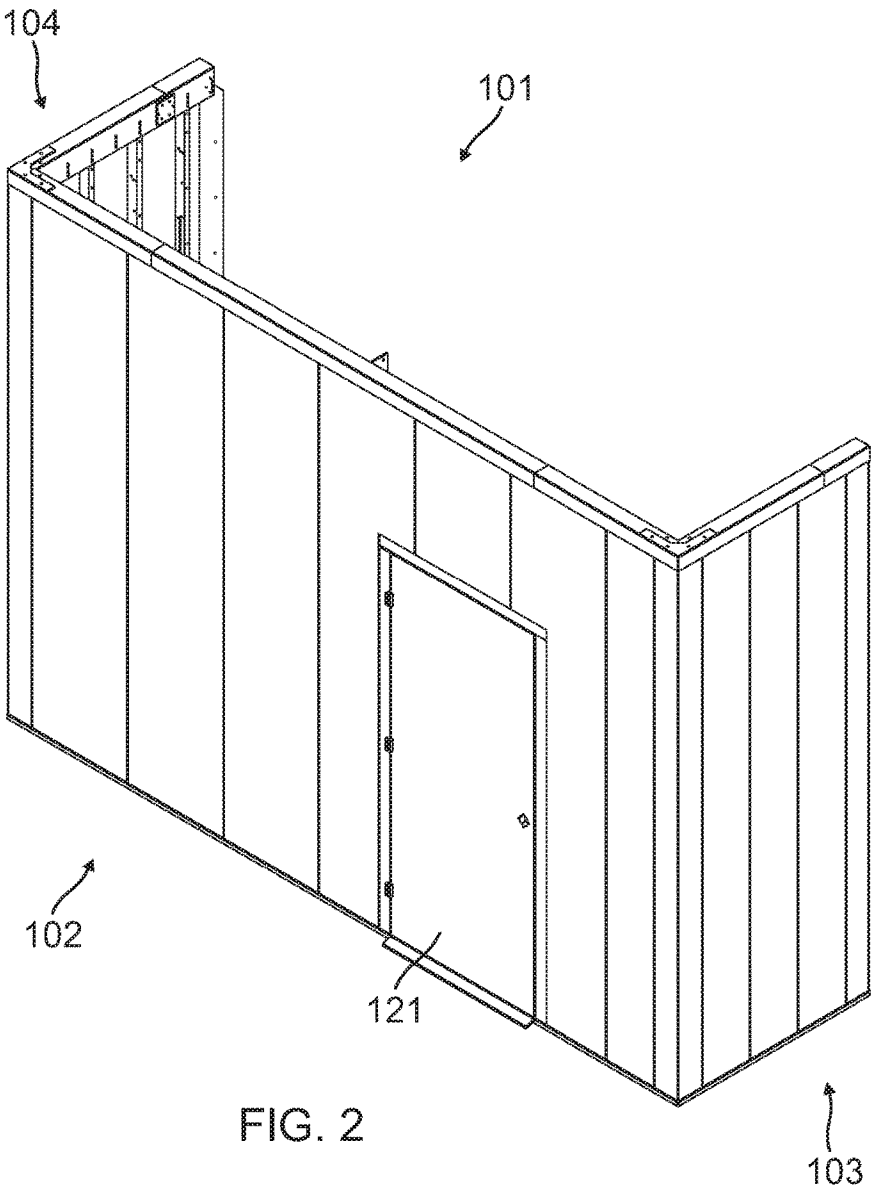
FIG. 2 is a perspective assembled view of the wall configuration of FIG. 1.

With reference now to the drawing, and more particularly to FIGS. 1 and 2, three-segment wall structure 101 is shown comprised of front section 102, right wing section 103 and left wing section 104.

As shown, front wall panels 105 are ten feet high and nominally 24 inches wide. As modular elements they could as well be eight or twelve feet high, and they could be six or 12 inches wide. These dimensions are provided for purposes of example only and promote modularity, but these panels are not so limited and they could have other dimensions.

Also included in wall structure 101 are starter panels 106, outside corner panels 107, bottom rail 111, bottom rail corner kit 112, top rail 113, top rail corner kit 114, door assembly 115, generally comprised of left single door panel 116, right single door panel 117, center single door panel 118, and door 121. The door frame is comprised of bottom single door frame panel 122, top single door frame panel 123, left single door frame panel 124, and right single door frame panel 125. It is contemplated that these members will provide as a completed assembly when specified to be part of a wall or enclosure structure.

Additional useful or ancillary members include splice bracket fastener 131, anchor mount fastener 132, and bracing plate fastener 133. These and other ancillary members will be described later.

Figure 3B:
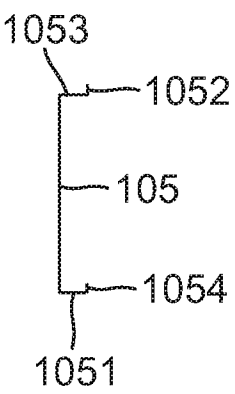
FIG. 3B is an end view of the wall panel of FIG. 3A.
Figure 3A:
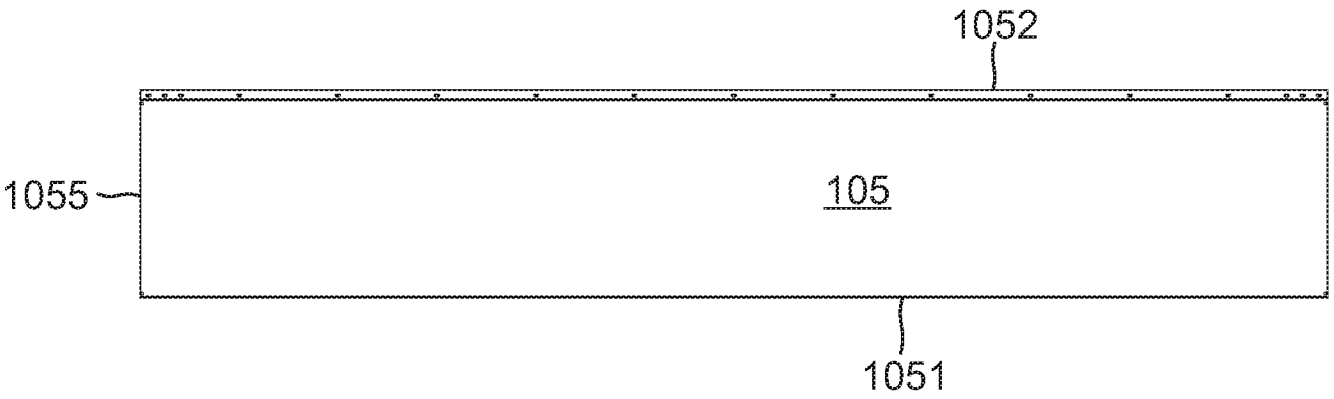
FIG. 3A is a front view of a wall panel as employed in the FIGS. 1 and 2 embodiments.
Figure 4A:
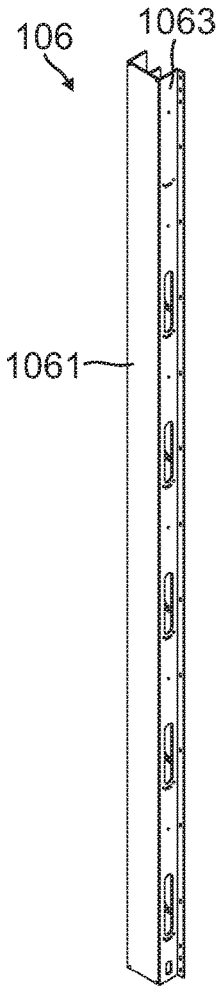
FIGS. 4A and 4D show perspective views of left and right starter panels as employed in the FIGS. 1 and 2 embodiment.
Figure 4B:
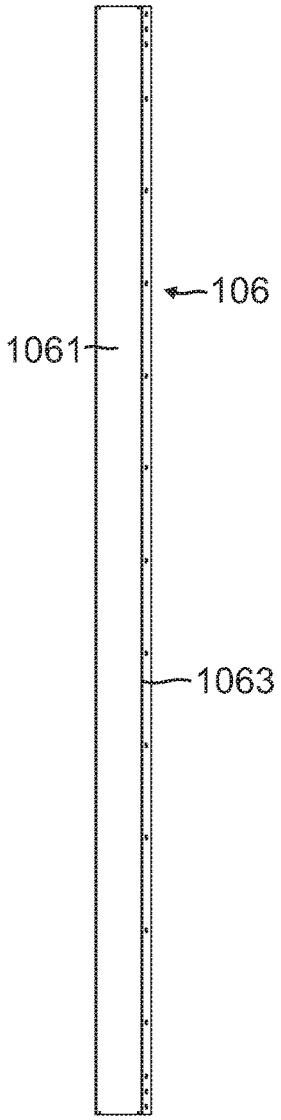
FIG. 4B is a front view of the left starter panel of FIG. 4A.
Figure 4D:
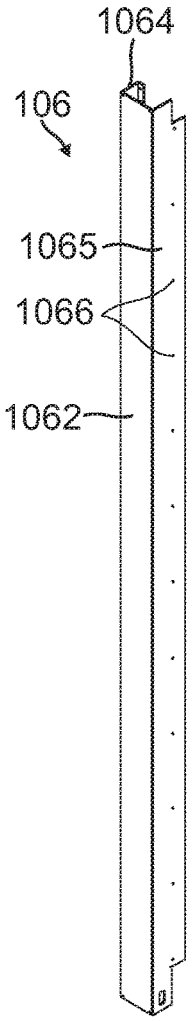
Figure 4E:
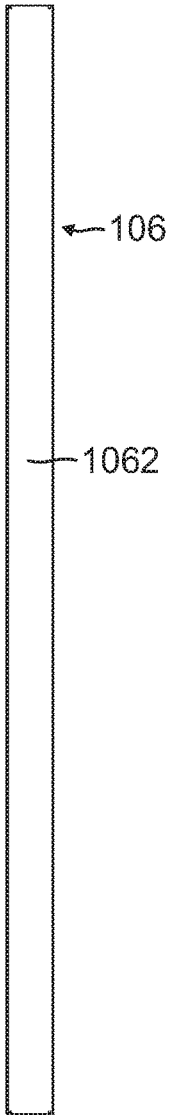
FIG. 4E is a front view of the right starter panel of FIG. 4D.
Figure 4C:
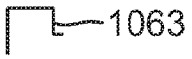
FIG. 4C is an end view of the left starter panel of FIG. 4A.
Figure 4F:
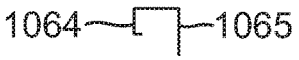
FIG. 4F is an end view of the right starter panel of FIG. 4D.

FIG. 3 is a wall panel 105 in isolation and in horizontal orientation. As stated above, the height of a wall panel is preferably eight feet, ten feet, or 12 feet, and its width is preferably six, 12, or 24 inches. These dimensions promote modularity but are not limiting. FIG. 3 shows that each long edge of the wall panel includes a full length flange. With reference to FIG. 3B, linear flange 1051 is "L" or hook shaped with an inward ridge 1054, and opposite flange 1053 is "Z" shaped with an outwardly extending ridge 1052. It can easily be seen how flanges 1051 and 1053 engage or nestle with the mating flange on an adjacent panel. When two panels are adjacent and engaged, they are firmly secured together with appropriate hardware, such as metal screws. Note that FIG. 3B appears to be a line drawing because it is an end view of what is essentially a sheet metal panel. The same is true of other end views described below. Left end 1055 in FIG. 3A is the top end, consistent with the panels shown in FIG. 1.

From FIG. 4 it can be seen that starter panel 106 is configured to engage the adjacent wall panel. Left starter panel 1061 is shaped to match with a wall panel 105 at the end of wall structure left wing 104. FIGS. 4B and 4C show that flange 1063 is shaped to engage flange 1051 of wall panel 105. Right starter panel 1062, as shown in FIGS. 4D, 4E, and 4F, is shaped to match with a wall panel 105 at the end of wall structure right wing 103. FIGS. 4D and 4F show that flange 1064 is shaped to engage flange 1053 of a wall panel 105. The flat flange 1065 of right starter panel 1062 shows spaced holes 1066 which may be pre-drilled therein by which suitable hardware such as nails, screws, rivets and rivnuts, or the like, can be employed to secure starter panel 1062 to a wall, if that is desired. Alternatively, holes 1066 may be formed or drilled in situ as the starter panel is ready to be secured to a wall. Equivalent holes are provided in left starter panel 1061 for connecting that panel to a wall.

Figure 5A:
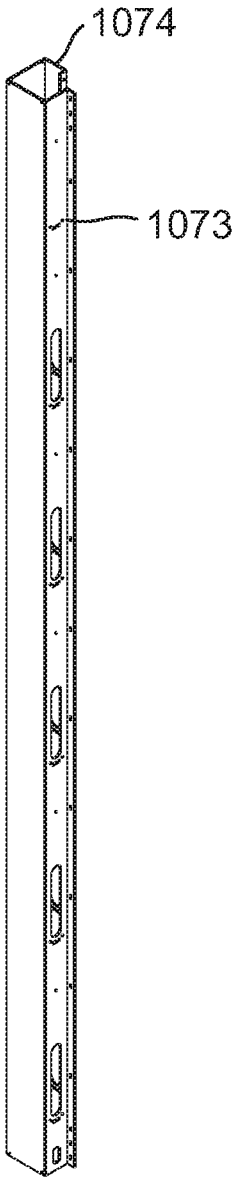
FIG. 5A is a perspective view of an outside corner panel as employed in the FIGS. 1 and 2 embodiment.
Figure 5B:
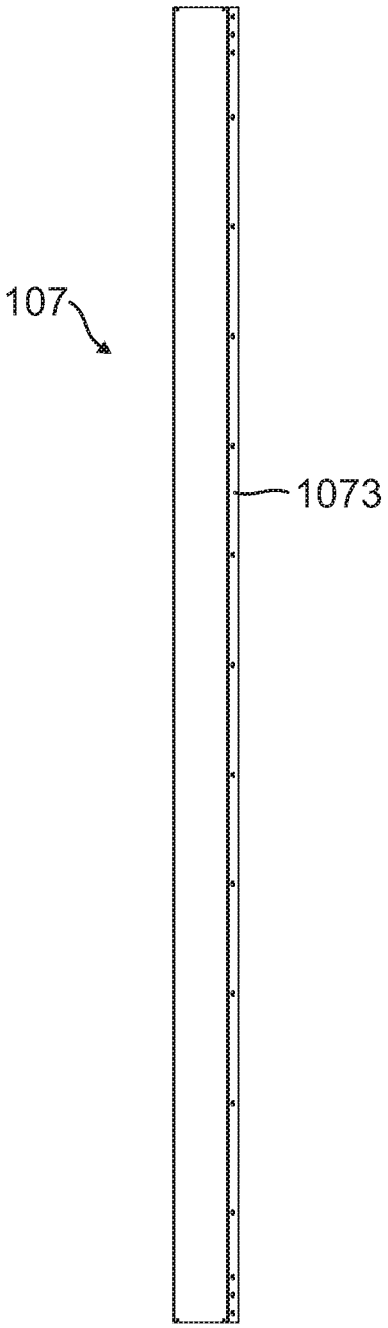
FIG. 5B is a front view of the outside corner panel of FIG. 5A.
Figure 5C:
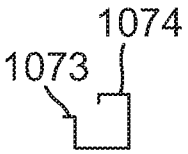
FIG. 5C is an end view of the starter panel of FIG. 5A.

Outside corner panel 107 is shown in FIGS. 5A, 5B, and 5C as it is employed in the FIGS. 1 and 2 embodiment. It can be seen that flanges 1073 and 1074 are configured to mate with the wall panels 105 on either side of a corner in the same way that a wall panel mates with similar wall panels on either side of it.

Figure 6A:
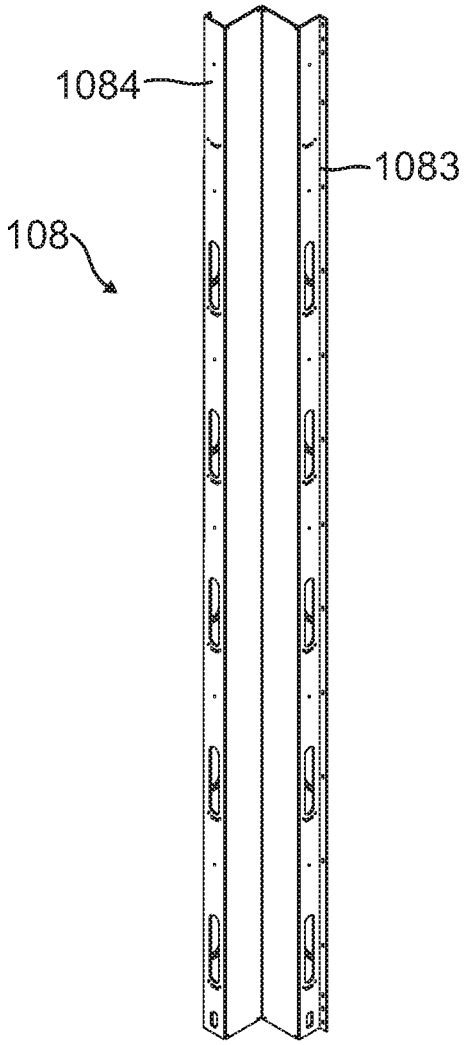
FIG. 6A is a perspective view of an inside corner panel as could be employed in the FIGS. 1 and 2 embodiment if the wall configuration had a forward angled wing.
Figure 6B:
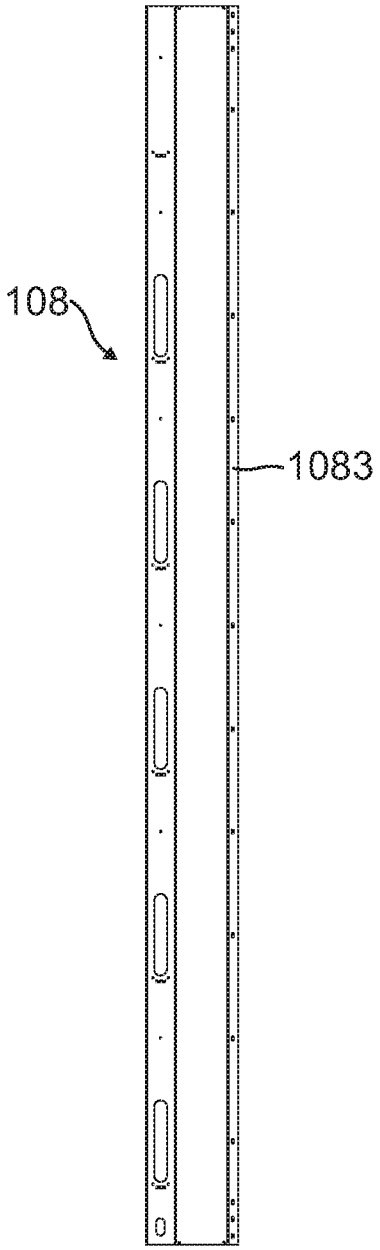
FIG. 6B is a front view of the inside corner panel of FIG. 6A.
Figure 6C:
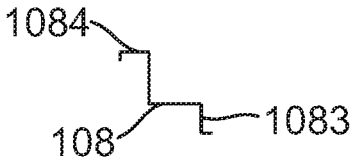
FIG. 6C is an end view of the inside corner panel of FIG. 6A.

Inside corner panel 108 is shown in FIGS. 6A, 6B, and 6C. Flange 1083 is equivalent to flange 1073 of the FIG. 5 corner panel, and flange 1084 is equivalent to flange 1074 in the FIG. 5 corner panel. This panel, of course, is used when the wall structure has an inside corner that is the primary way the wall would be viewed, opposite to the outside corner structure of FIGS. 1 and 2.

An apparatus for providing a finished surface to the inside of the wall structure of FIGS. 1 and 2 is shown in FIGS. 7-9.

Finish panel rail 141 can be mounted across several wall panels 105. This rail can be attached to either or both flanges 1052 and 1054 (see FIG. 3), which may alternatively be formed with holes along the length of the mating flanges. Rail 141 has holes 142, by means of which suitable hardware, such as metal screws, secure the rail to wall panels 105. As many rails 141 may be attached to a length of a constructed wall, such as front wall section 102, as may be desired. Typically there would be at least a top, a bottom, and a middle such rail, but more or fewer rails 141 could be employed.

In FIG. 7C is shown cutout 1414, which is depicted in the form of an isosceles trapezoid. This cutout has the width of slightly more than two thicknesses of a hook 152 of an interior finish panel (FIG. 8) at the bottom (narrow end) 1415, and a width at top 1416 of several times the thickness of a finish panel hook. Cutout 1414 need not be an isosceles trapezoid; that form is shown only as an example. Other cutouts having different shapes, possibly with curved sides with a narrowing at the bottom, could be effective.

Figure 8D:
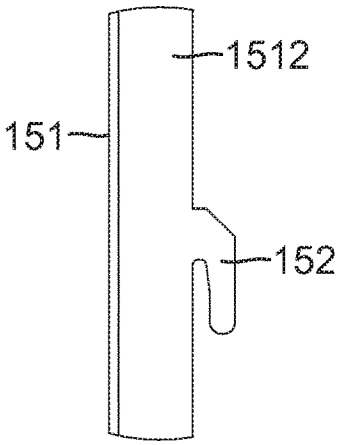
FIG. 8D is an enlarged view of a hook configured to engage a cutout of FIGS. 7A and 7C.
Figure 8B:
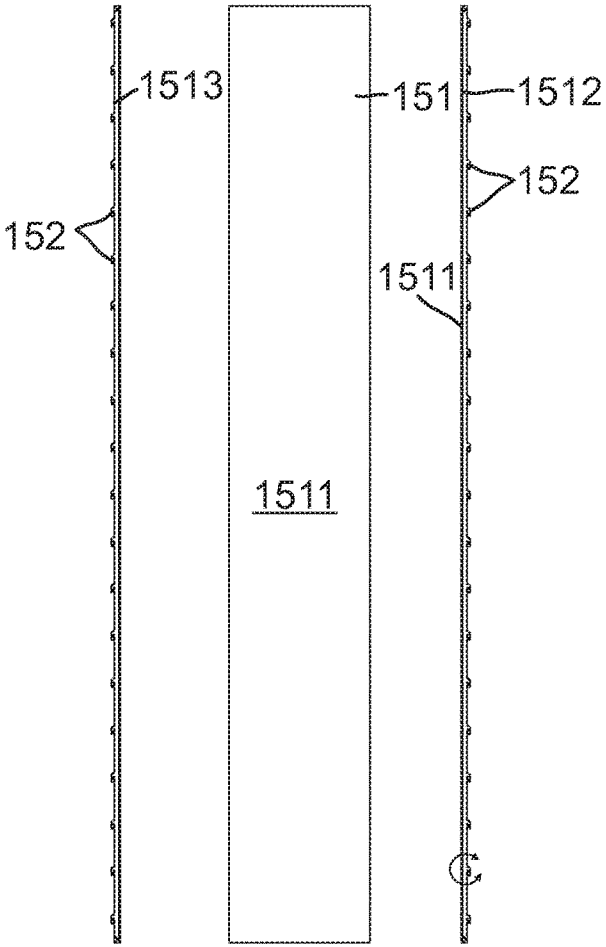
FIG. 8B is a front view, with right and left edge views of the interior finish panel of FIG. 8A.
Figure 8C:
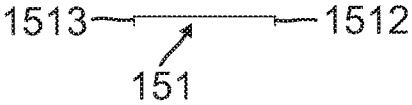
FIG. 8C is an end view of the interior finish panel of FIG. 8A.
Figure 8A:
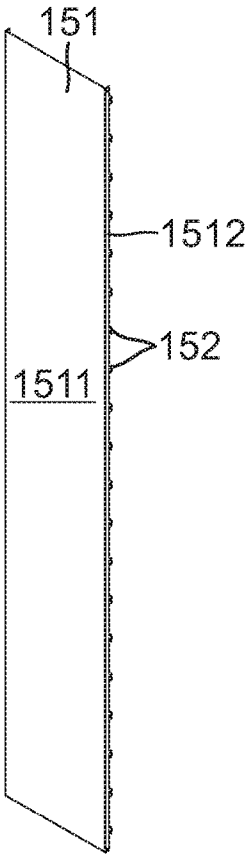
FIG. 8A is a perspective view of an interior finish panel which is configured for use with the FIGS. 1 and 2 embodiment.

FIG. 8 shows interior finish panel 151 having rearwardly (from face surface 1511) projecting flanges 1512 (right edge) and 1513 (left edge), each flange including a plurality of spaced hooks 152 (see FIG. 8C and left and right flanges 1513 and 1512, respectively). More specifically, FIG. 8A is a perspective view of interior finish panel 151. FIG. 8B is a combined figure showing a side view, and both right and left edge flanges 1512 and 1513, respectively, and a side view of hook 152 extending rearwardly from face 1511 on edge flange 1512.

Figure 9C:
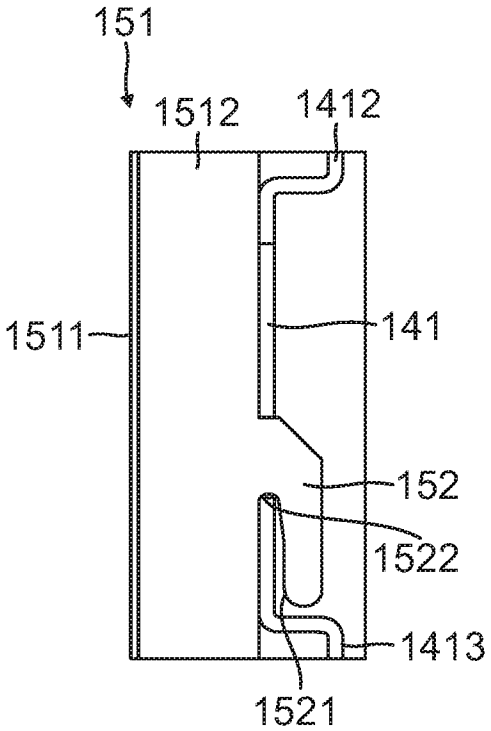
FIG. 9C is an enlarged partial side view of a hook fully engaged in a cutout of FIG. 7C.
Figure 9B:
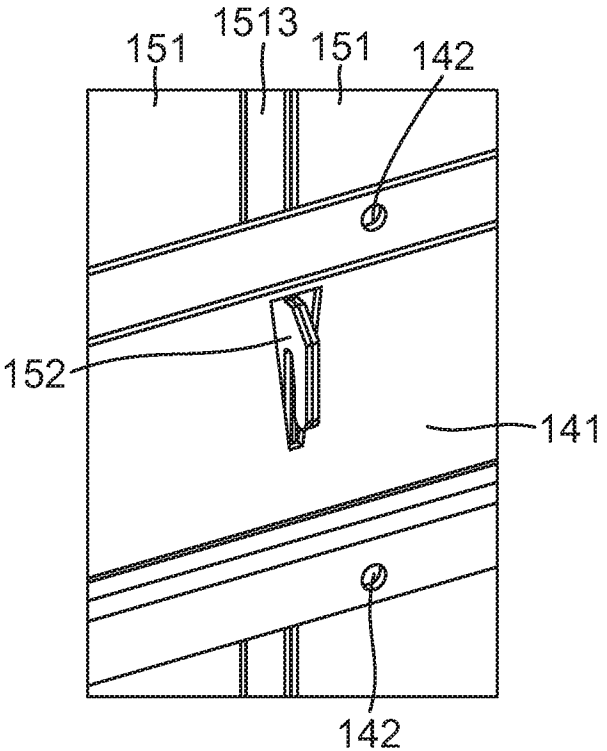
FIG. 9B is a partial isometric view of hooks of FIGS. 8D and 9A partially engaged in the cutout of FIG. 7C.
Figure 9A:
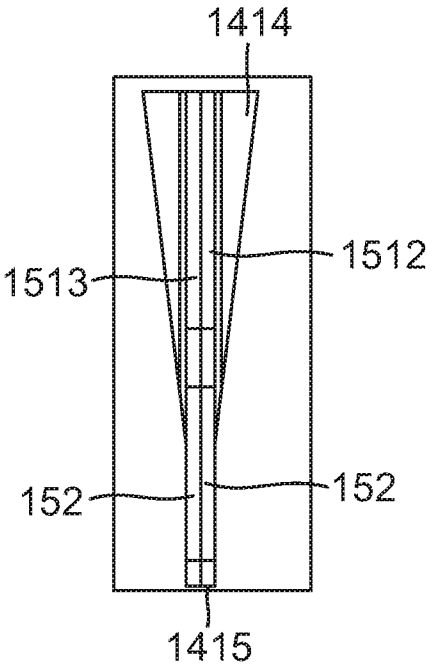
FIG. 9A is an enlarged view of a cutout of FIG. 7C engaged by the hooks of two interior finish panels of FIGS. 8A and 8C.

As is shown in FIG. 9A, cutout 1414 accommodates two facing hooks 152 projecting from two adjacent interior finish panels 151 in narrow end 1415 of the cutout. Flanges 1512 and 1513 of two abutting panels 151 share the slot in the lower portion of cutout 1414, as can be seen in FIGS. 9A and 9B.

FIG. 9C is an enlarged partial view of flange 1512 with hook 152 engaging cutout 1414 in rail 141. The rail is secured to the flanges projecting rearwardly from wall panels 105.

The shapes of cutouts 1414 and hooks 152 are purposeful. By being longer than hooks 152, and having a larger opening at end 1416, the cutouts can be easily engaged by two parallel interior finish panel hooks 152, either one at a time or simultaneously. As the panels 151 are lowered with the hooks initially projecting into the upper part 1416 in a cutout 1414, the tapered shape of the bottom portion 1415 of the cutout brings the two adjacent panels together so that flanges 1512 and 1513 of those two panels abut each other.

With reference to FIG. 9C, it can be seen that the interior surface of hook 152 is tapered so that gap 1521 is wider at the bottom opening than at blind end 1522. This shape ensures that when panel 151 engages rail 141 and when hooks 152 are fully at the lower end 1415 of cutout 1414, interior finish panel 151 is seated snugly against the rail.

The basic wall system has been described. For a more practical and complete system, a number of additional structures and elements are used. Elements which bring the wall panels more firmly together and provide a finished look are shown in FIGS. 10-13.

Figure 10B:
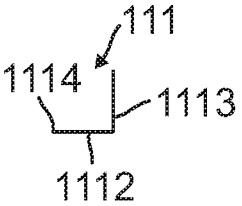
FIG. 10B is an end view of the bottom rail of FIG. 10A.
Figure 10A:
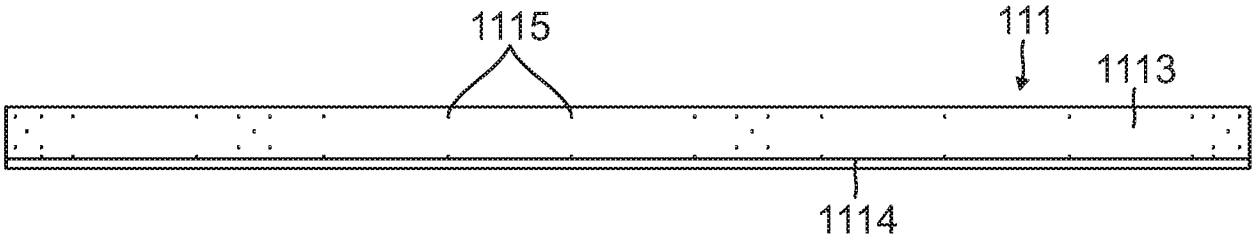
FIG. 10A is a front view of a bottom rail as can be used with the FIGS. 1 and 2 embodiment.
Figure 11:
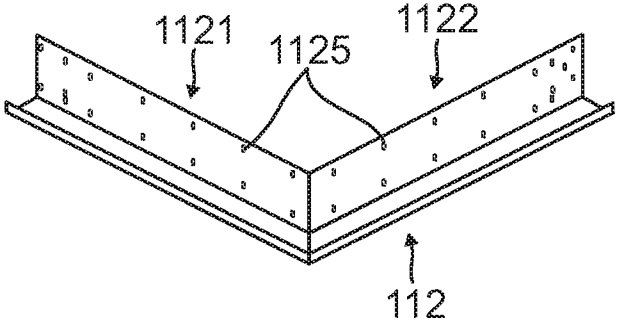
FIG. 11 is a perspective view of a bottom rail corner kit as can be used with the FIGS. 1 and 2 embodiment.

Bottom rail 111, shown in FIGS. 1 and 10, is formed with a flat, floor-contacting portion 1112, inner upright wall 1113, and outer flange 1114, detailed in FIG. 10B. To accommodate wall corners, bottom rail corner kit 112 is used and is shown in FIGS. 1 and 11. Left wing 1121 and right wing 1122 are essentially mitered portions of a bottom rail, secured together at 90°. Bottom rail corner kit 112, has the same cross-section as bottom rail 111. The left and right corner kits are the same, only rotated by 90°. The bottom rail corner kit structures may be identical, merely reoriented for a different corner.

As shown in FIGS. 1 and 10, structural wall panels 105, starter panels 106, and corner panels 107 are seated in the channel formed by flat bottom portion 1112, inner wall 1113, and outer flange 1114 of the bottom rail. Bottom rail 111 is cut to lengths as necessary to provide a mounting base for the wall panels. Alternatively, the wall panels are serially mounted in bottom rail 111 and secured together as previously described, and secured to inner wall portions 1113 of bottom rails 111 and bottom rail corner kits 112. Holes 1115 in bottom rails 111 and holes 1125 in bottom rail corner kit 112 facilitate affixing wall panels 105 to the bottom rails and corners by suitable means such as metal screws and the like.

Figure 12B:
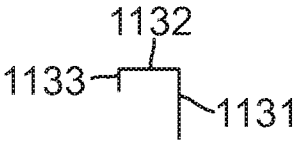
FIG. 12B is an end view of the top rail of FIG. 12A.
Figure 12A:
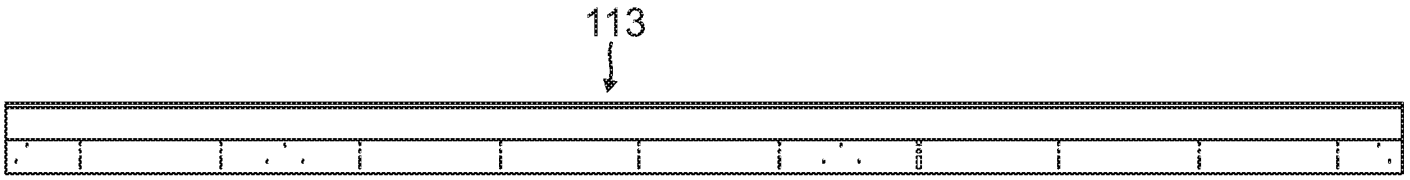
FIG. 12A is a front view of a top rail as can be used with the FIGS. 1 and 2 embodiment.

Similarly, top rail 113 is shown in FIG. 12. The top rail is, in general, a mirror image of the bottom rail, as shown in end view FIG. 12B. While not being necessary to a wall structure, the top rails offer increased stability and the look of a finished structure. The top rail has an inner wall portion 1131, a flat top portion 1132, and an outer flange 1133, thereby creating a channel in which the tops of wall panels 105, corner panels 107, and starter panels 106 reside.

Figure 13:
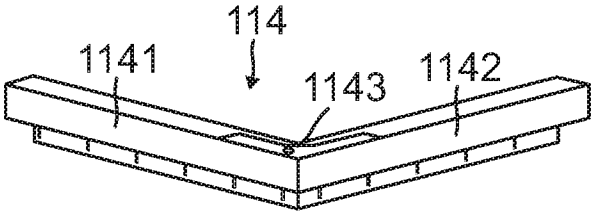
FIG. 13 is a perspective view of a top rail corner kit as can be used with the FIGS. 1 and 2 embodiment.

To accommodate wall corners, top rail corner kit 114 is used, as shown in FIGS. 1 and 13. Left main wing 1141 and right wing 1142 are secured together at 90°, preferably with corner bracket 1143.

The top rails and top rail corner kits are preferably prepared with holes by which they may be secured to the tops of wall panels 105, respectively, by suitable means such as metal screws or any of the other hardware connecting elements listed previously.

Figure 14B:
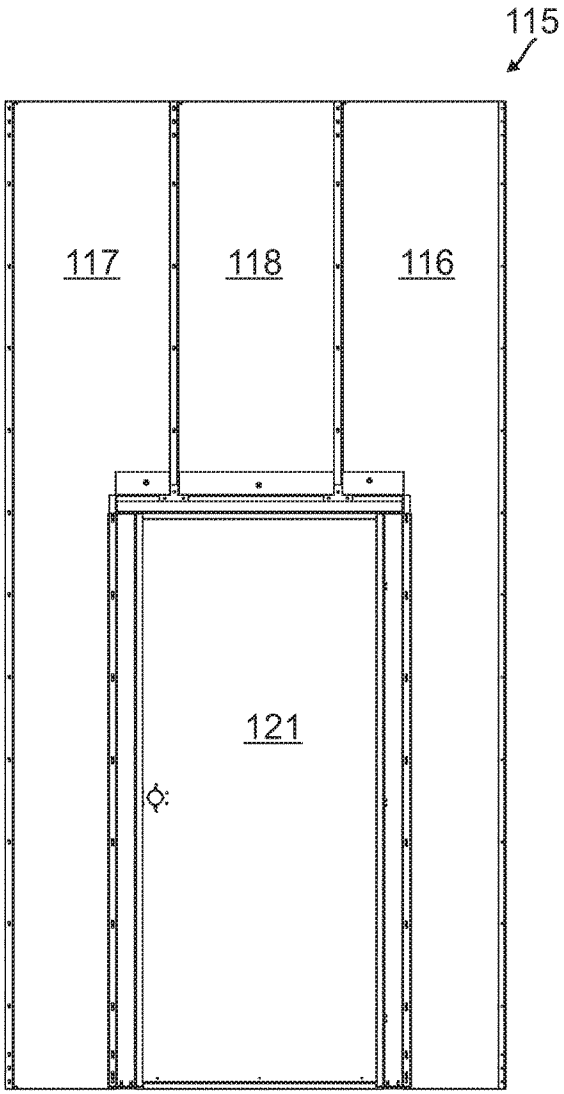
FIG. 14B is a back side view of the single door assembly of FIG. 14A.
Figure 14A:
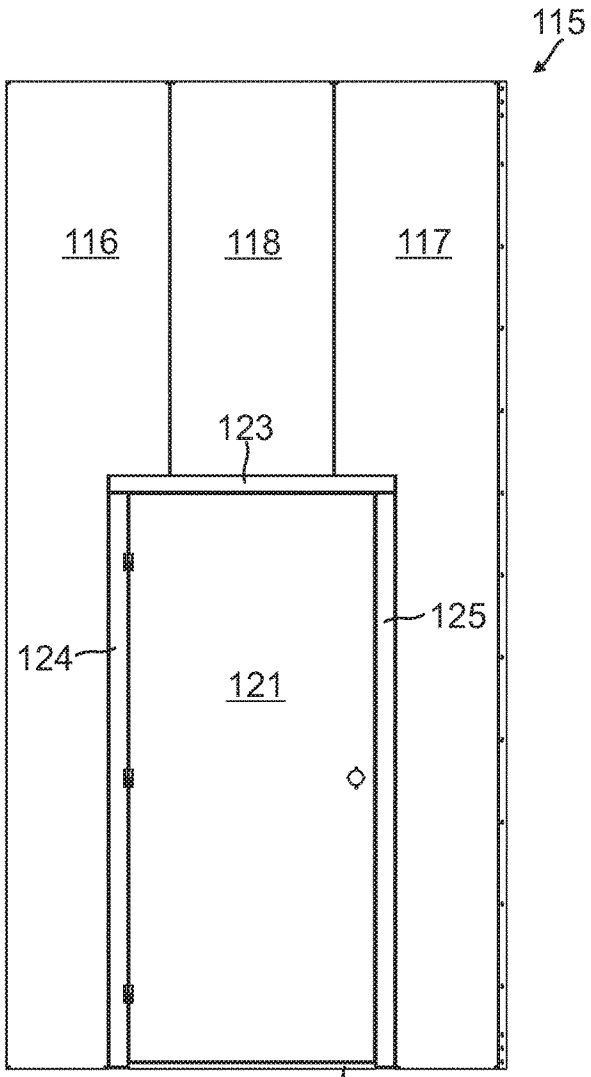
FIG. 14A is a front view of a single door assembly as shown in FIGS. 1 and 2.
Figure 15B:
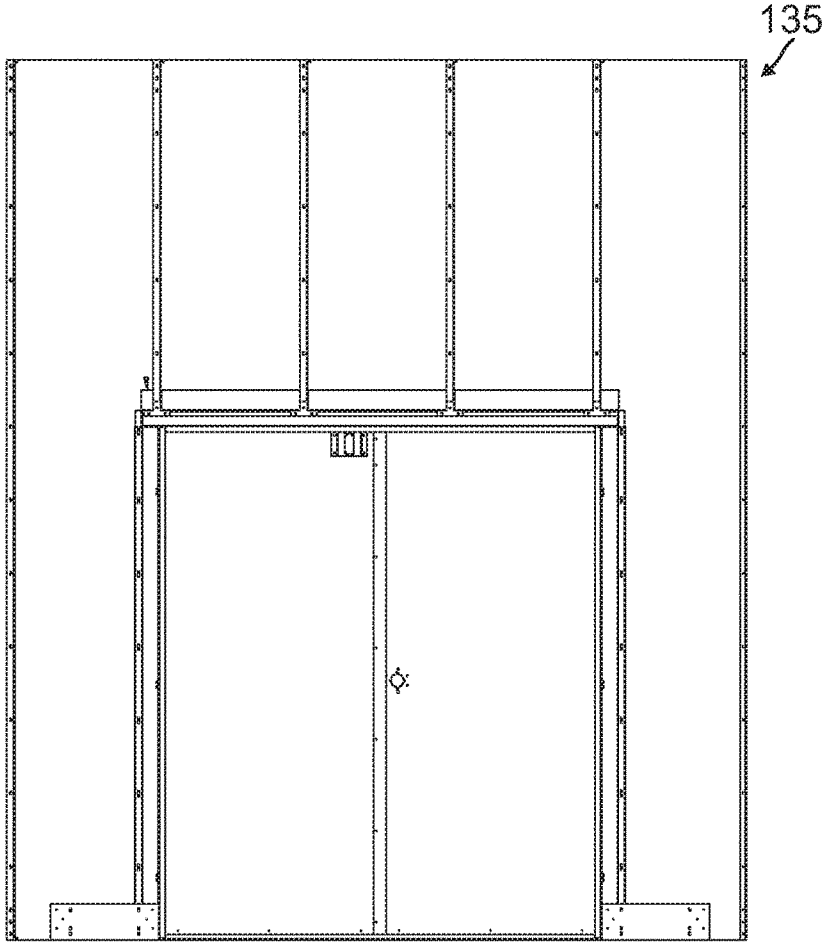
FIG. 15B is a back side view of the double door assembly of FIG. 15A.
Figure 15A:
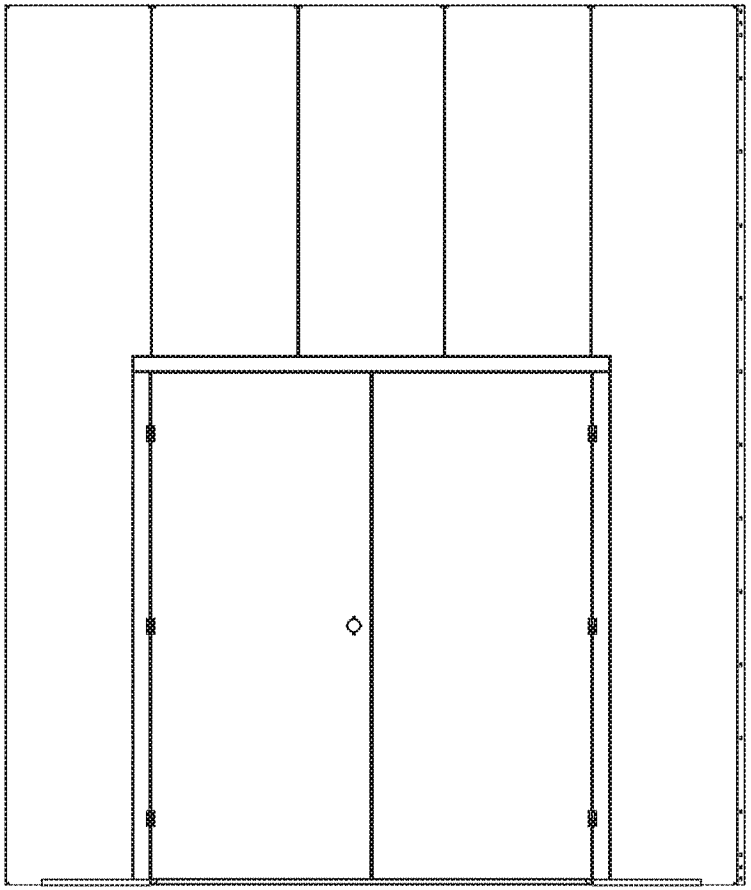
FIG. 15A is a front view of a double door assembly as can be used with the wall system of FIG. 1.

Another option, but likely to be requested by the user, is the single door assembly 115 as shown in FIG. 14. An alternative is the double door assembly 135 shown in FIG. 15.

Panels 116, 117, and 118 are typically modifications of basic wall panels 105. Left door panel 116 would normally be the same width and height as adjacent wall panel 105, modified to accommodate the left side of the door and left single door frame panel 124. Panel 117 has a similar shape, it is modified to accommodate the right side of the door and the right single door frame panel, and center single door panel 118 is effectively a short segment of a wall panel 105.

Top door frame panel 123 and bottom door frame panel 122, as well as left and right single door frame panels 124 and 125, respectively, are not shown in detail because, as contemplated, the single and double door assemblies are provided as optional modular units which can be incorporated into a wall structure 101 (FIGS. 1 and 2).

While a three section wall panel system is shown in FIG. 1, the modular elements shown can be used to form a single, linear wall, which can be free standing or can be attached to walls at one or at each end. Additionally, this system can be employed to form a wall or a fully enclosed room with a door, for example, and the wall or enclosure can be portable or free standing and not anchored to a floor, wall, or ceiling.

Returning to FIG. 1, splice bracket fastener 131 may be used, together with hardware (metal screws, for example) as mentioned elsewhere herein, to secure together two ends of adjacent bottom rails or top rails. Anchor or floor mount fasteners 132 may be used to secure bottom rails and bottom rail corner kit assemblies to the floor, if needed. Bracing plate fasteners 133 may be used to secure the top rails and top rail corner kit assemblies to the ceiling, if needed or desired. Several of these elements are shown in FIG. 1 as examples. Not all of them are identified with reference numerals. A person or ordinary skill in this field of endeavor would not need to have explicit directions as to which or how many of these elements they would use or exactly how to use them.

Figure 16:
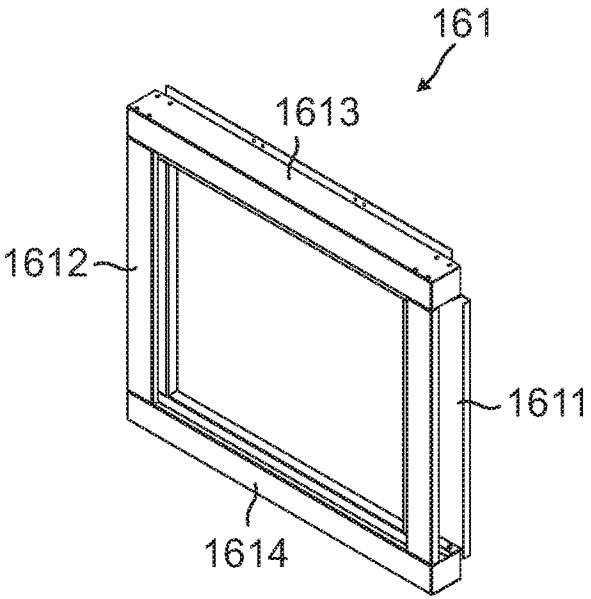
FIG. 16 is a perspective view of a window module that can be incorporated into the wall system embodiment of FIGS. 1 and 2.

Another option is a window 161 as shown in FIG. 16. This could have the same width as a wall panel and would connect with adjacent wall panels in the same way that adjacent wall panels are connected to each other. More specifically, window frame member 1611 would be connected to the mating edge of a wall panel 105 and window frame member 1612 would be connected to the opposite edge of another wall panel 105. Wall panel segments are cut to size so that an upper wall panel segment can be connected to upper window frame member 1613 and a lower wall panel segment can be connected to lower window frame member 1614. The connections would normally be by means of screws or rivets, for example, as described for other connections.

Figure 17:
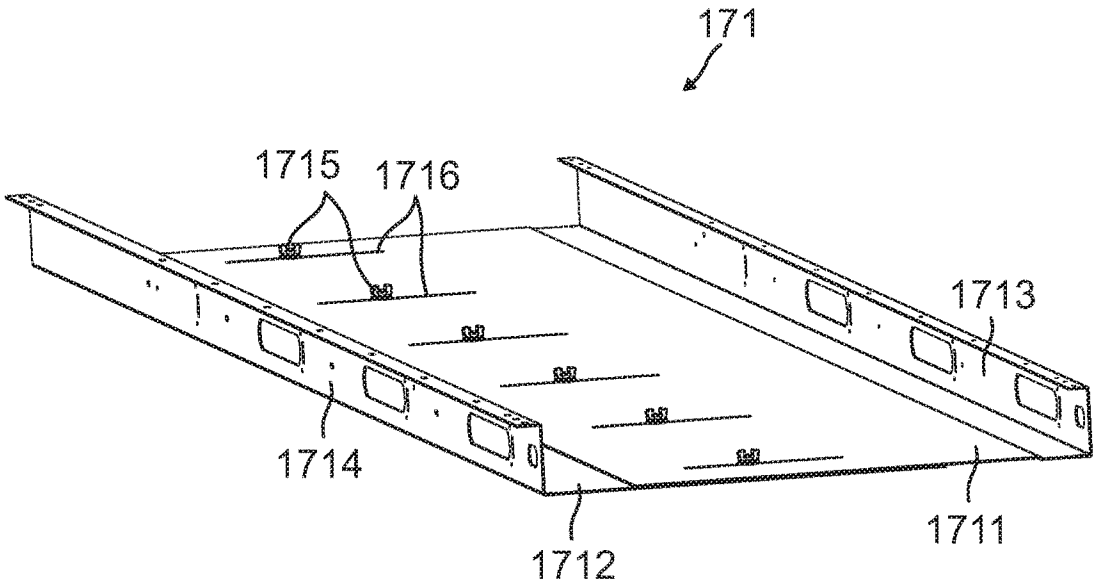
FIG. 17 is a perspective view of the back side of an adjustable horizontal sliding panel assembly that can be employed with the FIGS. 1 and 2 embodiment.

Horizontal sliding panel 171 is shown in FIG. 17. It is noted that the modular widths of wall panels 105 are anticipated to be six, 12, and 24 inches. In situations where the smallest space between panels is less than six inches, sliding panel 171 can be used to replace a wall panel 105 which has a nominal 12 inch width in a space which is 17 inches wide, for example. Panel element 1711 is mated with panel element 1712 and those two panel elements may be slidingly secured together with Pem inserts, comprised of cylinders with threads. "Pem" is a registered trademark of PEM Management, Inc., of Wilmington, Del. As shown here, the Pem inserts are mounted in panel element 1712 and project through slots 1716 in panel element 1711.

As used on the job site, one panel member, 1711 for example, is fastened to a panel 105, where flange 1713 mates with flange 1053 of the wall panel (see FIG. 3). Panel element 1712, to which the Pem inserts are mounted, is then slid to engage the next adjacent panel 105 so that flange 1714 mates with flange 1051 of that wall panel. Panels 1711 and 1712 are then secured together with wingnuts 1715 which engage the threaded portion of the Pem inserts which extend through slots 1716 in panel element 1711.

A component which lends additional flexibility to the entire system is the variable angle corner panel assembly of FIGS. 18 and 19. Outside corner assembly 181 is shown in FIG. 18A and inside corner assembly 182 is shown in FIG. 18C.

Figure 18B:
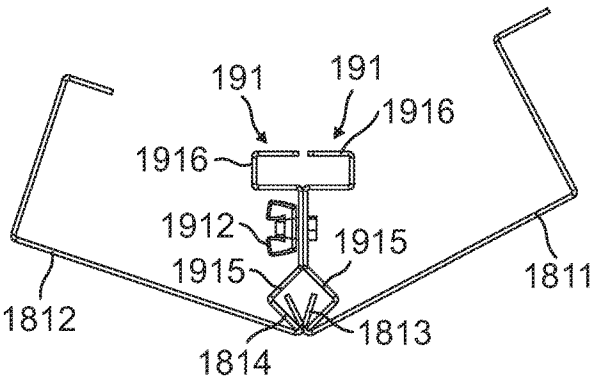
FIG. 18B is an end view of the assembly of FIG. 18A.
Figure 18C:
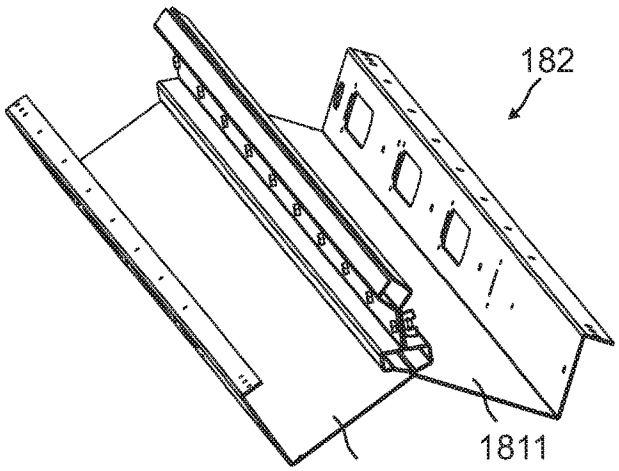
FIG. 18C is a perspective view of an inside variable angle corner panel assembly.
Figure 18A:
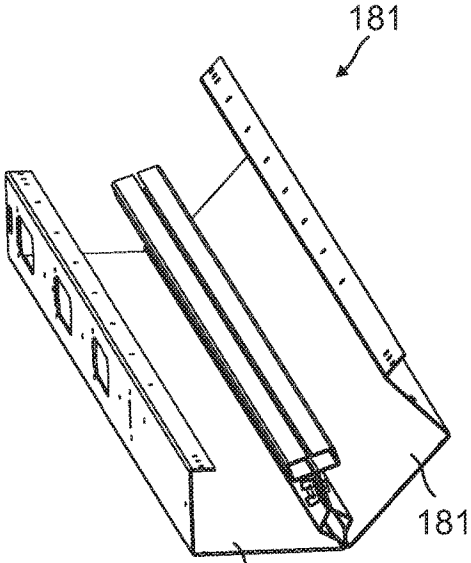
FIG. 18A is a perspective view of an outside variable angle corner panel assembly.
Figure 18E:
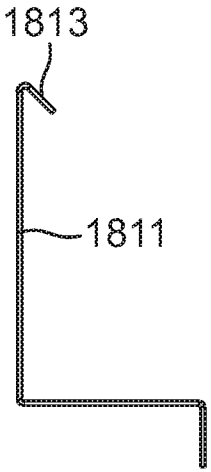
FIG. 18E is an end view of one of the panel elements shown in FIGS. 18A and 18C.
Figure 18D:
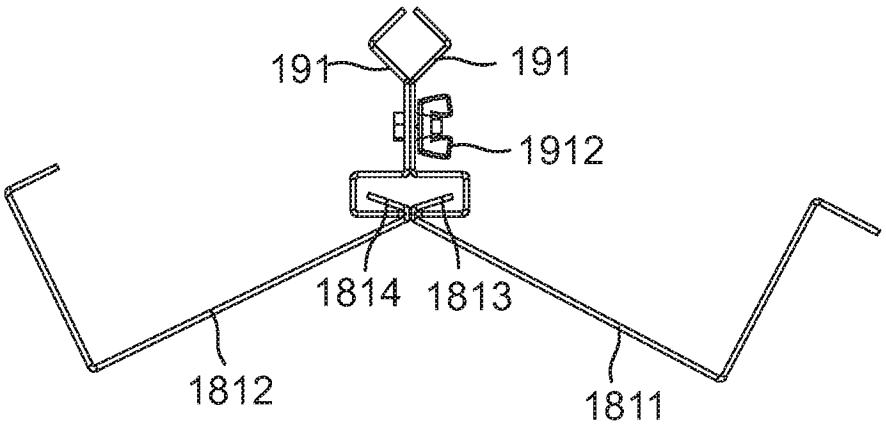
FIG. 18D is an end view of the assembly of FIG. 18C.

These assemblies are shown in end views in FIGS. 18B and 18D, respectively.

Figure 18F:
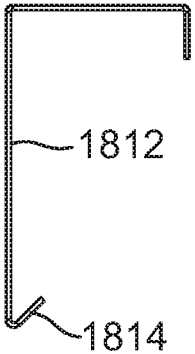
FIG. 18F is an end view of the other panel element shown in FIGS. 18A and 18C.

The shape of each corner panel is evident from FIGS. 18A and 18C. Panel 1811 of outside corner assembly 181 is shown in end view in FIG. 18E and panel 1812 of outside corner assembly 181 is shown in FIG. 18F. It should be noted that panels 1811 and 1812 are used for both the outside and the inside corners of FIGS. 18A and 18C, respectively.

Figure 19B:
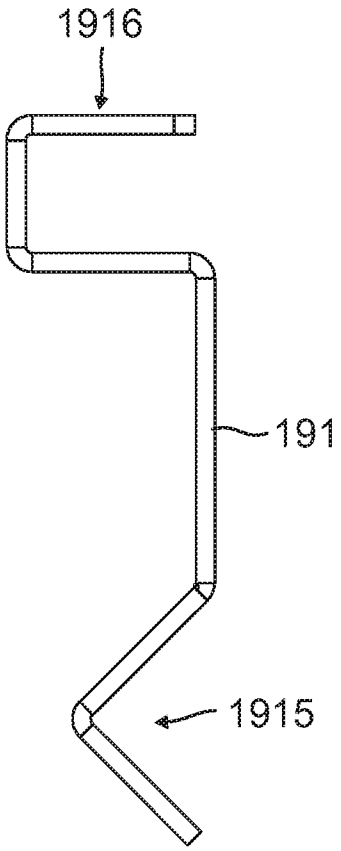
FIG. 19B is an end view of the angle panel clamp of FIG. 19A.
Figure 19A:
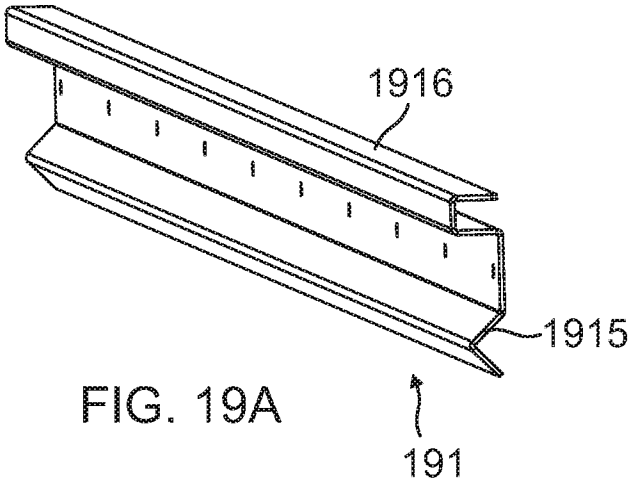
FIG. 19A is a perspective view of the angle panel clamp shown in FIGS. 18A-18D.

Elongated clamp element 191 is shown in perspective in FIG. 19A and in end view in FIG. 19B. Two of these clamp elements are employed, along with appropriate hardware, such as a bolt and wingnut 1912, for example, for either the outside corner (FIG. 18B) and the inside corner (FIG. 18D).

For the outside variable angle corner 181 of FIGS. 18A and 18B, a panel 1812 (FIG. 18F) and a panel 1811 (FIG. 18E) are butted together with their sharp hook edges 1813 and 1814 touching. Then two clamp elements 191 are placed in facing relationship with reverse bend ends 1915 enclosed around the inside of hook ends 1813 and 1814, as shown in FIG. 18B. Wingnut 1912, together with suitable bolt-type hardware, are then used to secure hook edges 1813 and 1814 together. As shown in FIG. 18B, this combined corner panel assembly has an included possible angle ranging from about 90° to about 180°, being shown here with an exemplary angle of about 135°.

Similarly, the other hook ends 1916 of clamp element 191 are used in a similar manner to form insider corner 182 as shown in FIG. 18D. Sharp hook edges 1813 and 1814 are butted together but with panels 1811 and 1812 reversed so that the hooks are facing outward from the corner. Then hook ends 1916 (FIG. 19B) engage hook edges 1813 and 1814 as shown in FIG. 18D. The same hardware and wingnut engagement is made, as before, and the included possible angle of this arrangement is about 180° to about 270°.

It is quite evident how useful this corner angle flexibility can be when other than 90° corners are encountered when the present system is employed to construct a multi-direction wall or enclosure.

There are likely to be instances in practical situations where a temporary wall constructed according to this system and using at least some of the components disclosed will need to start at other than 90° from a wall. Variable angle right starter panel 195 is shown in FIG. 20. For reference, 90° fixed starter panel 106 is shown in FIGS. 1 and 4. The variable angle right starter panel is shown in detail in FIG. 20, and would replace panel 106 in right wing section 103, as seen in FIG. 1.

Figure 20A:
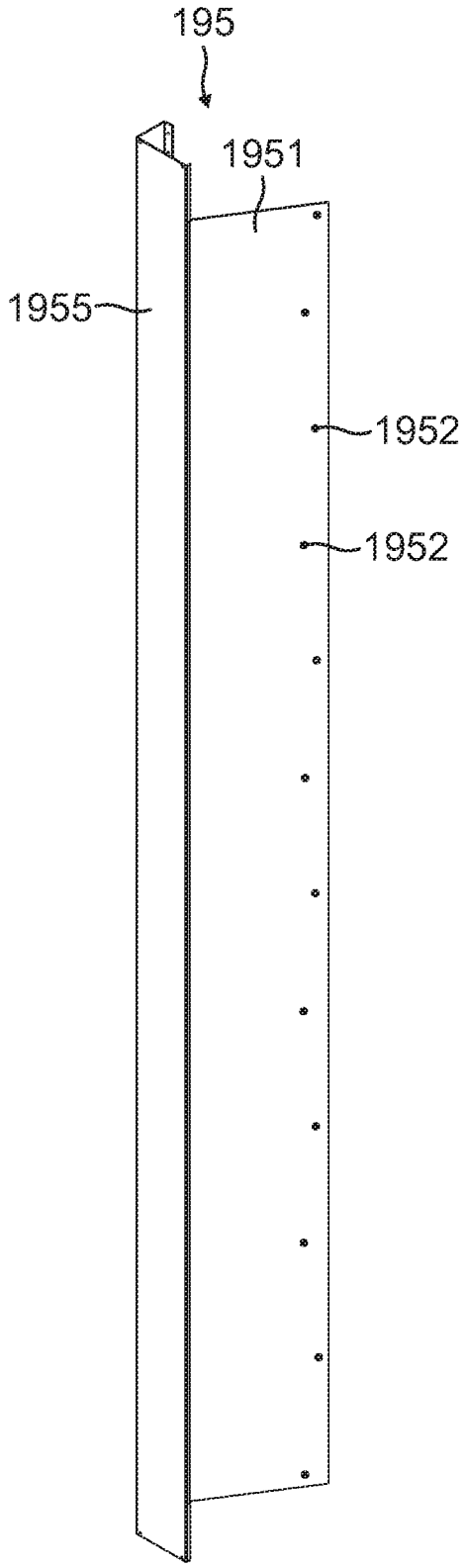
FIG. 20A is a perspective view of an alternative embodiment of a starter panel that can be employed with the FIG. 1 system, this being a variable angle right starter panel.
Figure 20B:
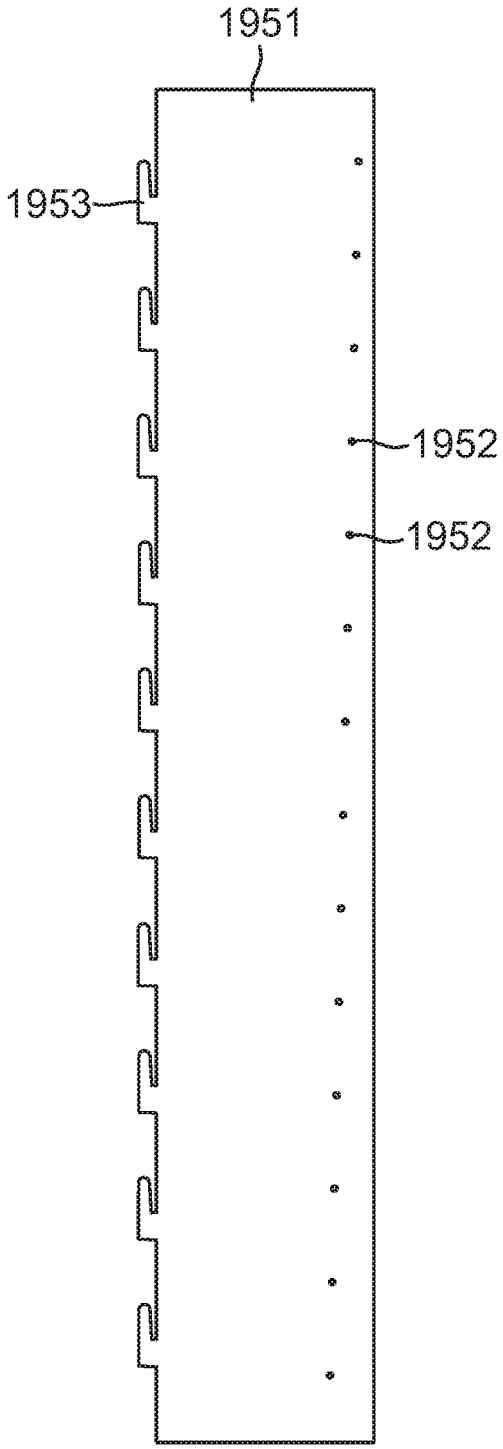
FIG. 20B is a front view of one element of the starter panel of FIG. 20A.
Figure 20C:
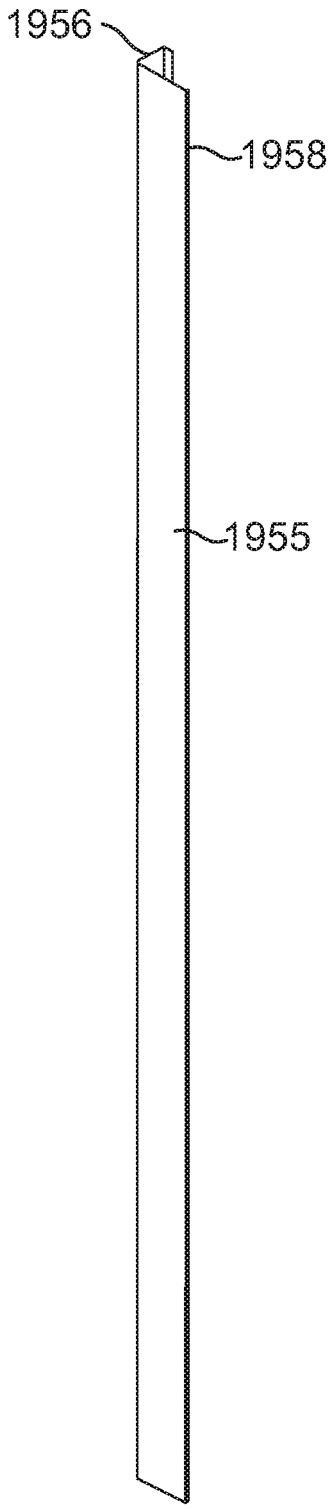
FIG. 20C is a perspective view of a second element of the starter panel of FIG. 20A.

Here the variable angle starter panel has two interconnecting elements, as shown in FIG. 20A. First is panel 1951 which is secured to the wall by means of nails, for example, through holes 1952. The holes may be pre-formed or created on the job. Panel 1951 is basically flat and has upwardly opening hook elements 1953 on the edge opposite to holes 1952, and is shown in front view in FIG. 20B.

Figure 20D:
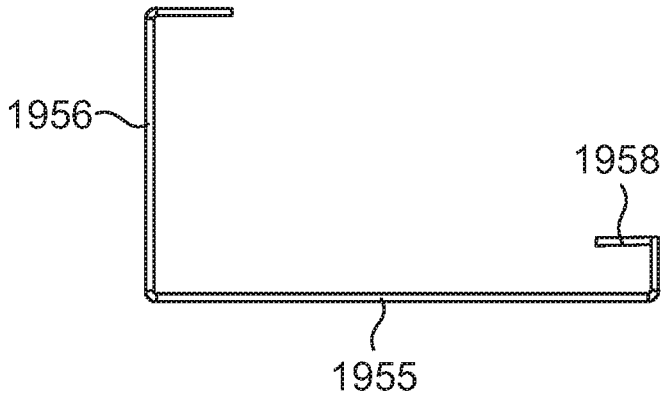
FIG. 20D is an end view of the element of FIG. 20C.

Elongated panel 1955 (FIG. 20C) has the end view shape shown in FIG. 20D. It can be seen that flange 1956 on one edge is formed to mate with the flange on one edge of a wall panel 105. Mating cutouts are formed in panel 1955 which engage the hook elements.

In the manner of the one-piece starter panel of FIGS. 1 and 4, panels 1951 and 1955 are coupled together and panel 1951 is secured to the location on a wall which has been chosen for the start of a wall to be constructed according to this system. It is noted that panel 1951 is a relatively thin sheet and that holes 1952 are along one edge. That leaves a slight amount of flexibility so that the hook-shaped edge flange 1958 is able to be engaged by hook elements 1953, which partially envelops the hook elements and can roll under the free edge of panel 1951 as panel 1955 rotates on the hooks of panel 1951.

As is easily perceived from FIG. 20, corner panel 195 can be secured to the wall and, at the same time, enables panel 1955, which would be secured to the adjacent panel 105, to swing through a relatively wide angle. For practical purposes, it is unlikely that the angle of a wall system structure, with respect to the building wall, would ever be as great as 45°, but such an angle is possible. Thus, the included angle of variable angle starter panel is 0° to 45°.

Figure 21A:
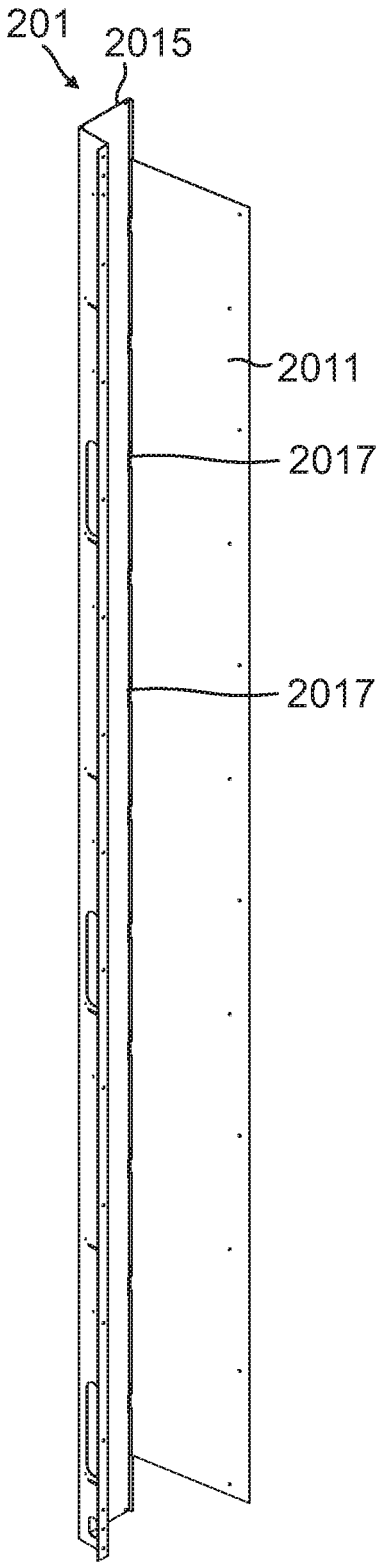
FIG. 21A is a perspective view of an alternative embodiment of a starter panel that can be employed with the FIG. 1 system, this being a variable angle left starter panel.
Figure 21B:
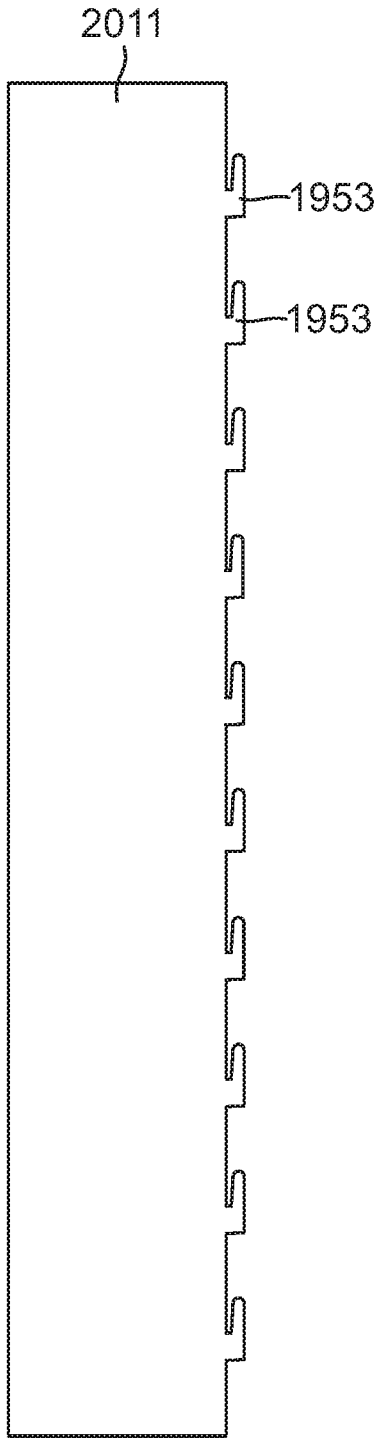
FIG. 21B is a front view of one element of the starter panel of FIG. 21A.

Variable angle left starter panel 201, shown in FIG. 21A, would replace starter panel 106 in left wing wall section 104 in FIG. 1. The elements of starter panel 201 are the same as those in FIG. 20, except that it is formed to mate with the other side edge of a panel 105.

Flat panel member 2011 would be the same as flat panel member 1951 if it is finished identically on both flat surfaces. Alternatively, it would be a separate, mirror image panel.

Figure 21C:
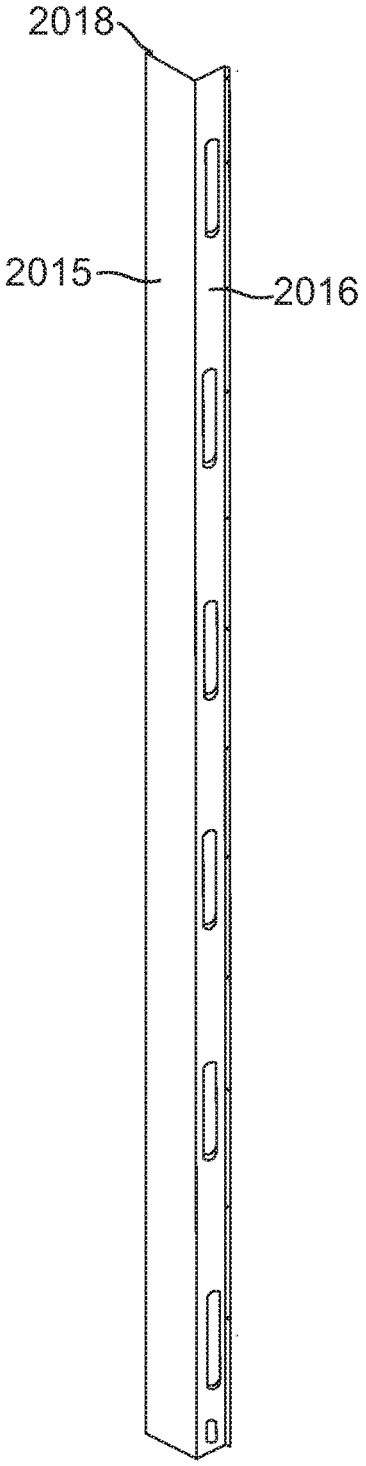
FIG. 21C is a perspective view of a second element of the starter panel of FIG. 21A.
Figure 21D:
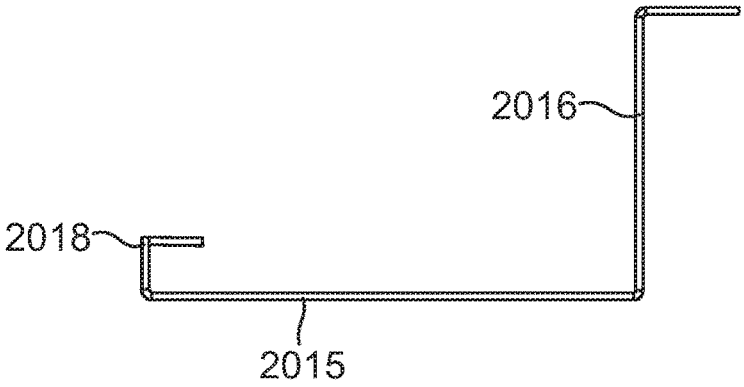
FIG. 21D is an end view of the element of FIG. 21C.

Elongated panel 2015 has the shape shown in FIGS. 21A and 21C, and in the end view, FIG. 21D. Flange 2016 is shaped to engage panel 105 in the left wing 104 of the wall system shown in FIG. 1. Hook shaped flange 2018 is formed with cutouts 2017 which are engaged by hooks 1953 in flat panel 2011 (1955).

The structure and use at the job site are the same for the FIG. 21 variable angle left starter panel 201 as for the variable angle right starter panel 195 in FIG. 20. There is no need to provide further details of this opposite side variable angle starter panel.

Figure 22:
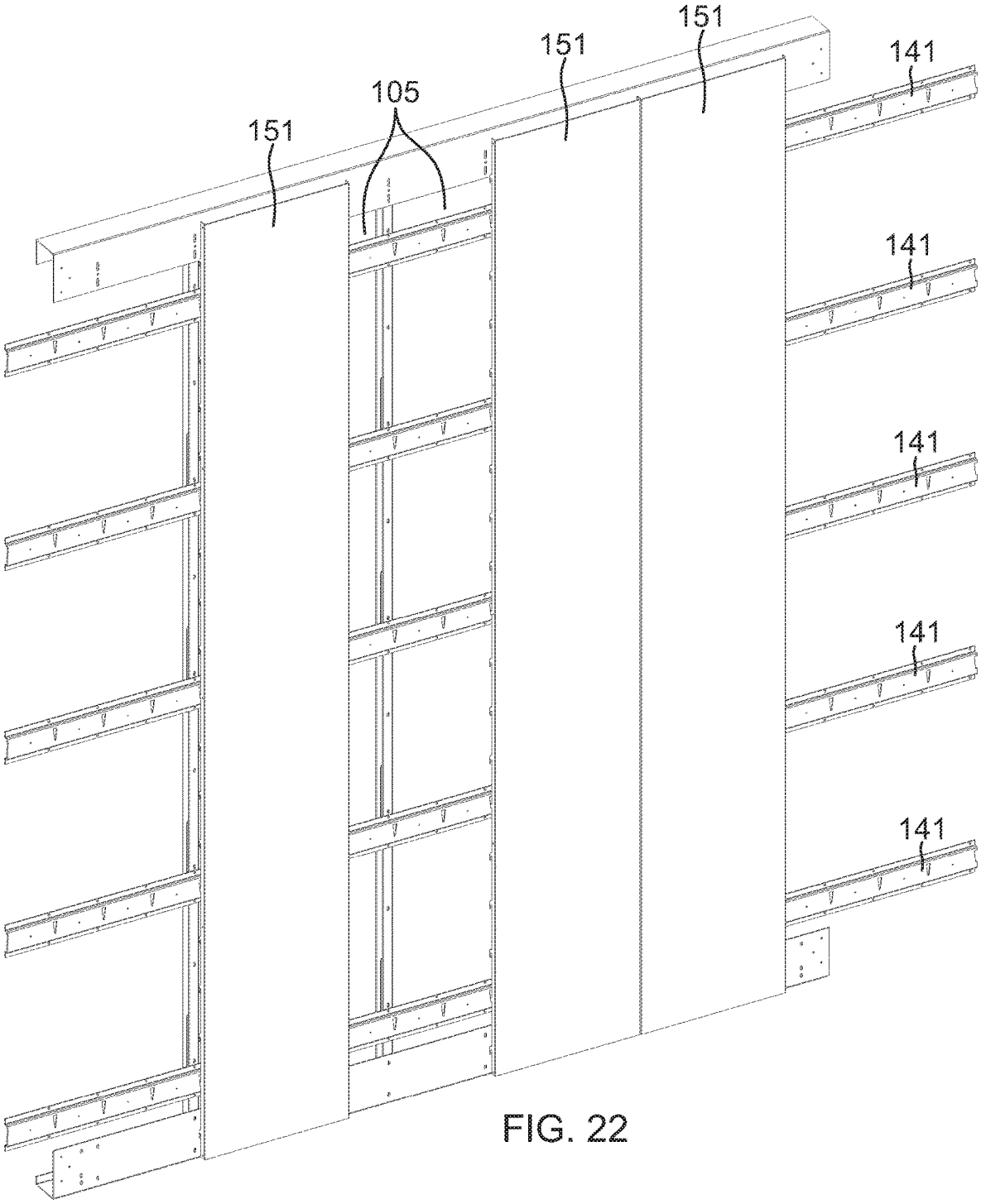
FIG. 22 is a partial perspective view of the interior finish panels of FIG. 8 mounted on the finish panel rails of FIG. 7 inside the wall panels of FIGS. 1-3.
Figure 23A:
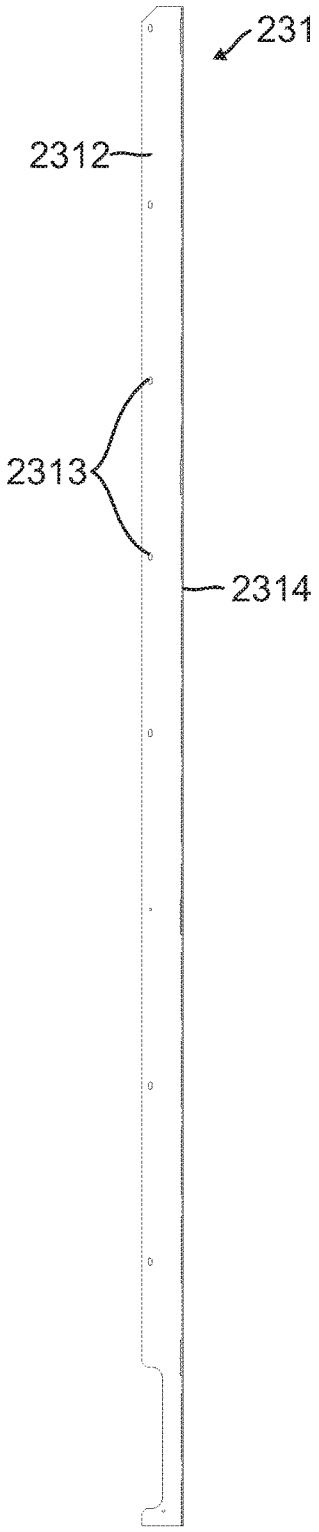
FIG. 23A is a side view of a vertical interior finish panel rail, an alternative to the horizontal rail of FIG. 7.
Figure 23B:
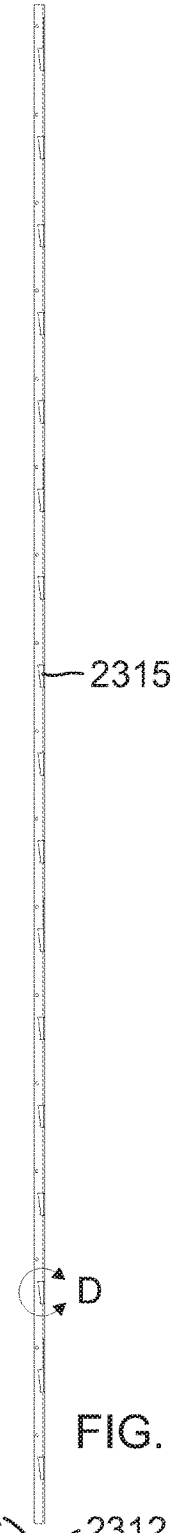
FIG. 23B is an edge view of the rail of FIG. 23A.
Figure 23C:
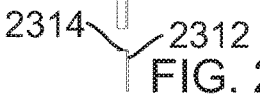
FIG. 23C is an end view of the rail of FIG. 23B.
Figure 23E:
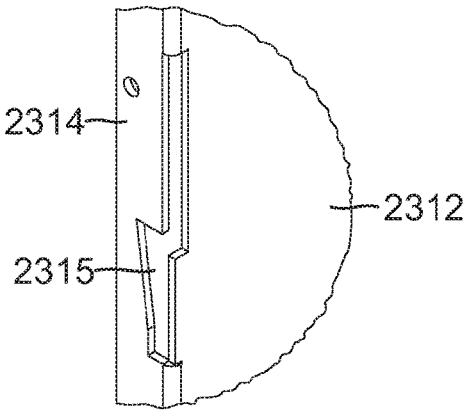
FIG. 23E is the same fragment as FIG. 23D, rotated to show the corner and the cutout from a different angle.
Figure 23D:
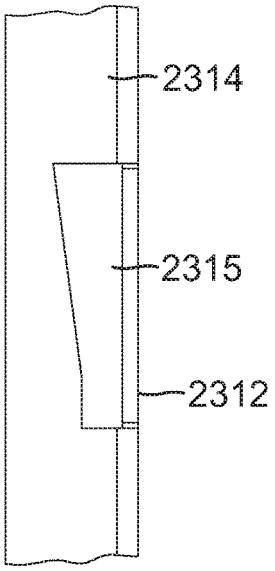
FIG. 23D is a fragmentary view of a cutout taken at detail D in FIG. 23B.

FIG. 22 is provided to clarify the relationships between wall panels 105, finish panel rails 141, and interior finish panels 151. Front wall panels 105, as shown in FIG. 11, appear in FIG. 22 from their inside or back side. Finish panel rails 141 of FIG. 7 are attached to the back side of wall panels 105 by suitable hardware, as previously stated, and interior finish panels 151 are hung on rails 141 as shown in FIGS. 8 and 9.

With reference to FIG. 23, an alternative arrangement for mounting the interior finish panels to the wall structure is shown. Horizontal finish panel rail 141 is shown in FIG. 7, and FIGS. 8 and 9 show how interior finish panels 151 connect to the horizontal rails, with the relationship of the horizontal rails to front wall panels 150 and interior finish panels 151 shown in FIG. 22. To reiterate, trapezoidal cutouts 1414 are configured to receive hooks 152 from two adjacent interior panels 151.

Vertical finish panel rail 231 is shown in FIG. 23. Vertical rail panel 2312 may be formed with holes 2313 prior to shipment or prepared on-the-job. Rail flange 2314 is arranged at about 90° with respect to panel 2312 and is formed with a series of trapezoidal cutouts 2315 at the intersection of panel 2312 with flange 2314 (FIGS. 23D and 23E). Holes 2313 facilitate connection of rail 231 to appropriate flanges 1051, 1053 (FIG. 3) of wall panels 105 by metal screws, or bolts, or the like. Since wall panels 150 and interior finish panels 151 will generally have equal widths, panels 151, with hooks 152, can be mounted to vertical rails 231 in the same manner as with the horizontal rails, as shown in FIGS. 8 and 9, that is, paired hooks 152 of adjacent panels 151 are securely nestled in a single cutout 2315. As stated previously, cutouts 2315 need not be trapezoidal in shape.

In FIGS. 1 and 4 is shown starter panel 106. The concepts of starter panels and vertical finish panel rails of FIG. 23 are incorporated in FIG. 24. Only left starter panel 241 is shown in detail here since both the left and the right starter panels of FIG. 4 were fully described previously.

Figure 24A:
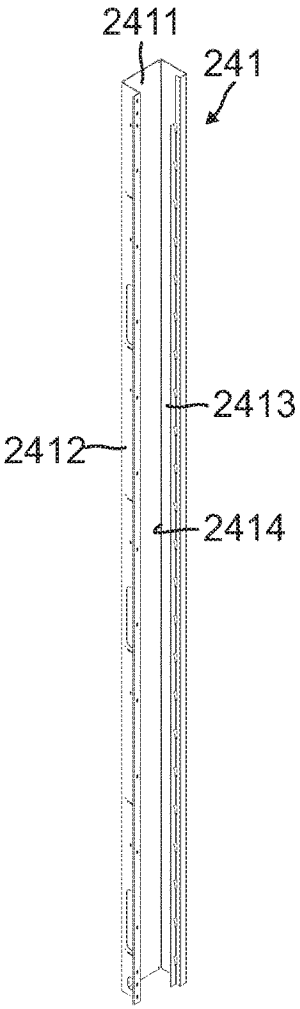
FIG. 24A is a perspective view of an alternative starter panel to be used with the vertical rails of FIG. 23.
Figure 24F:
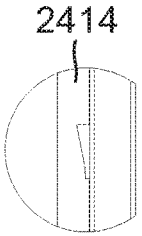
FIG. 24F is a fragmentary view of a cutout taken at detail F in the FIG. 24E.
Figures 24D, 24E:
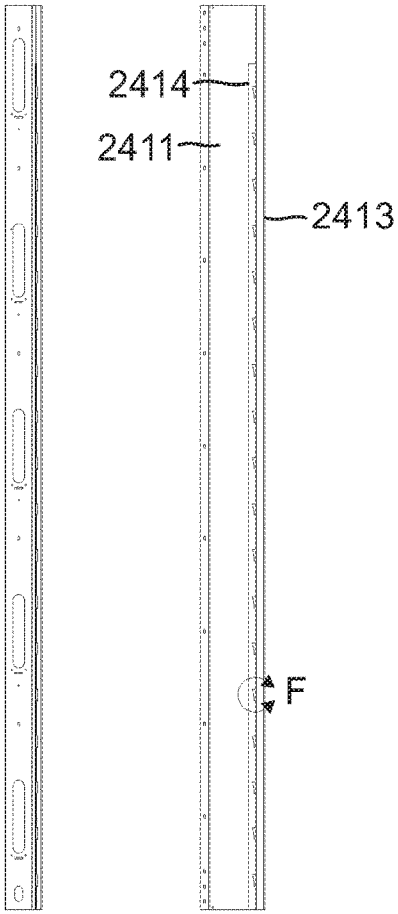
FIG. 24D is a side view of the panel, rotated 90° from FIG. 24B.
FIG. 24E is a back view of the panel of FIG. 24A.
Figure 24B:
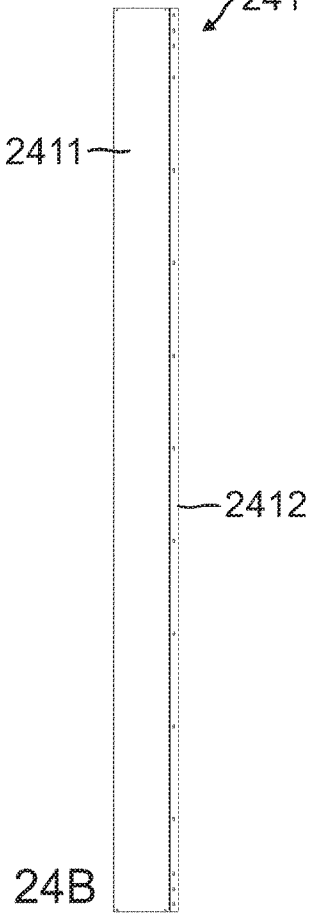
FIG. 24B is a front view of the starter panel of FIG. 24A.
Figure 24C:
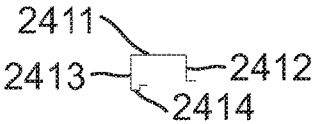
FIG. 24C is an end view of the panel of FIG. 24B.
Figure 25A:
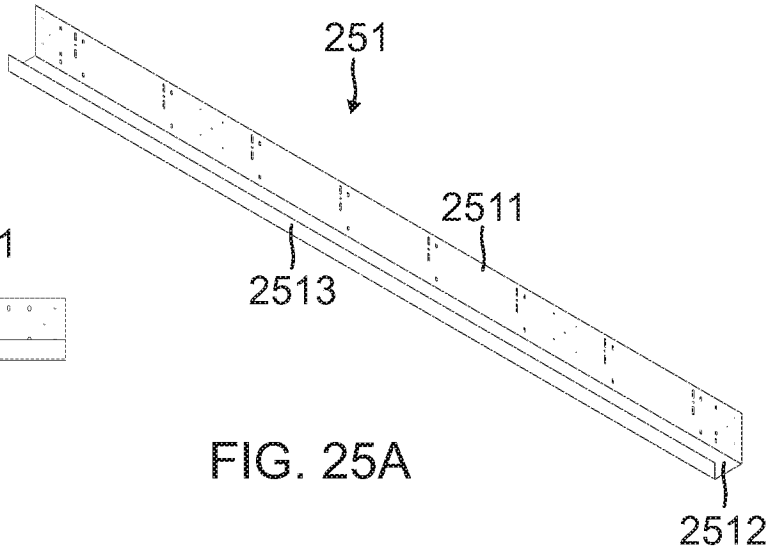
FIG. 25A is a perspective view of a top/bottom rail which can be used with the FIGS. 1 and 2 embodiments.
Figure 25B:
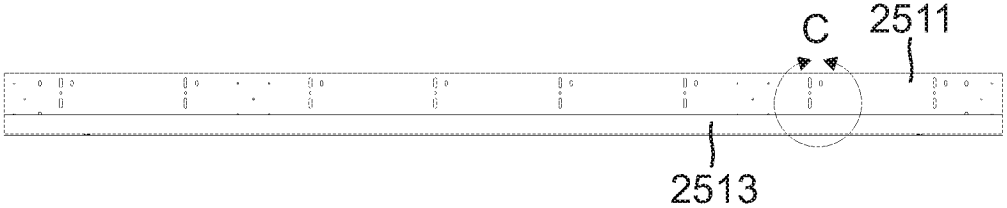
FIG. 25B is a front view of the rail of FIG. 25A.
Figure 25C:
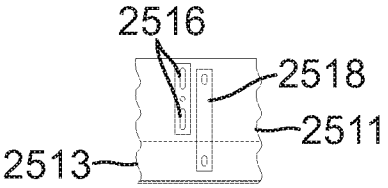
FIG. 25C is a fragmentary view of connection holes taken at detail C in FIG. 25B.
Figure 25D:
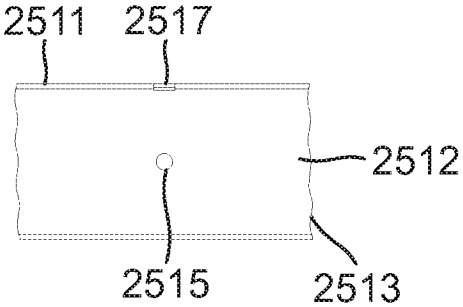
FIG. 25D is a top view of a fragment of the rail of FIG. 25A.

Panel 2411 is shown in FIG. 24A, with L-shaped flange 2412 and four-segment flange 2413 shown in an end view in FIG. 24C. The trapezoidal cutouts are located throughout the length of flange 2414 and are employed in the same manner as with vertical rails 231, as described above. Note that flange 2414 does not extend the full length of starter panel 241.

In FIGS. 1, 10, and 12 are shown bottom rail 111 and top rail 113. Rail 251 is shown in FIG. 25. This rail can be used as a top rail or as a bottom rail. When used as a bottom rail, holes 2515 in horizontal panel 2512 (FIG. 25D) may be used to anchor the rail to the floor by suitable means. Flange 2511 in FIGS. 25A, 25B, and 25C includes slots 2516 for connection to the top of wall panels 105. Slots 2518 are employed for connection to the bottom of the wall panels. At the intersection of panel 2512 and flange 2511 are spaced holes or cutouts 2517 for draining of fluids when rail 251 is employed as a bottom rail. Rail 251 also includes outer flange 2513, equivalent to flanges 1114 in FIG. 10.

There are instances where a wall may need to include a curve as opposed to an abrupt change of direction, such as a 90° corner. Such structure is shown in FIG. 26.

Wall segment 261 includes wall panels 105, modified wall panels 2611, top rail 2612, and bottom rail 2613.

Figure 26D:
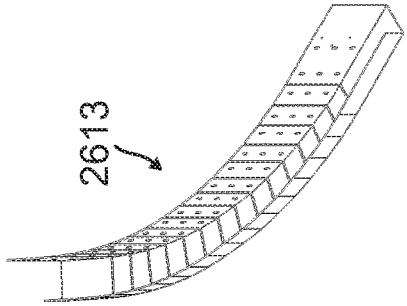
FIG. 26D is a perspective view of a top/bottom rail with a curved configuration as used in the FIG. 26 embodiment.
Figure 26E:
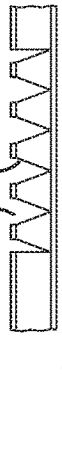
FIG. 26E shows a FIG. 26D rail segment prepared to be used with the FIG. 26 embodiment prior to being bent in a curve.
Figure 26A:
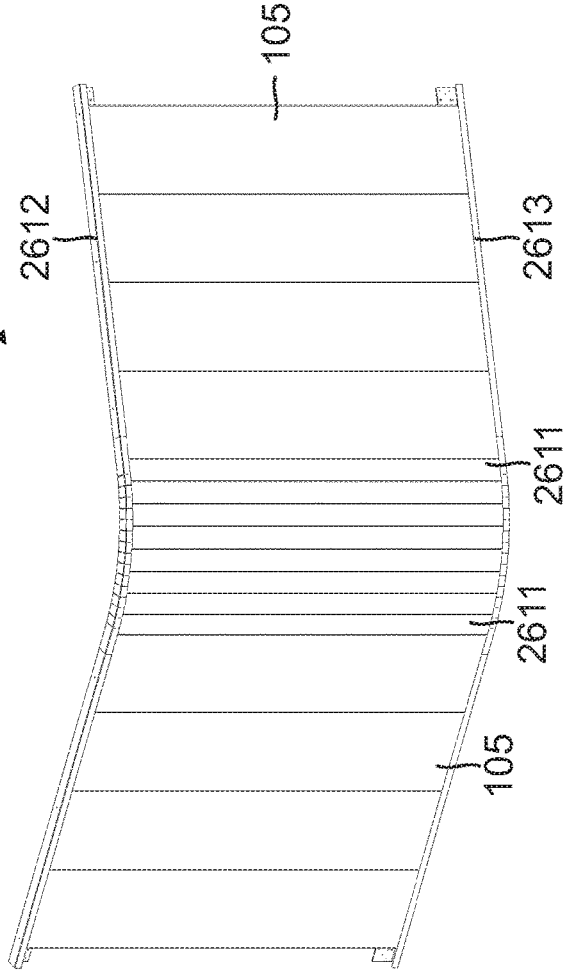
FIG. 26A is a perspective external view of two wall segments connected in a curve of less than a 90° angle.
Figure 26C:
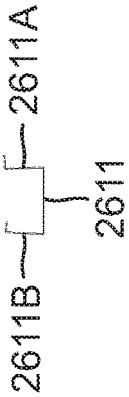
FIG. 26C is an end view of a wall panel used in forming the curved connection of FIG. 26A.

End view of FIG. 26C shows main panel member 2611 with normal flange 2611A and non-normal flange 2611B. That is, flange 2611B is at an included angle of less than 90°. When several such panels 2611 are fitted together, in the manner shown in FIGS. 1 and 3 for panels 105, a curve can be achieved, as depicted in FIG. 26A.

Bottom rail 2613 is shown in FIGS. 26D and 26E. As seen in FIG. 26E, bottom rail 2613 is formed with a series of wedged or angled slots 2614, which are shown exaggerated in this view for expository purposes. When so formed, rail 2613 can be bent until all the wedges are closed up, leaving the curve shown in FIG. 26D. The various holes and slots are for the purposes previously described with respect to the rail shown in FIG. 25.

Figure 26B:
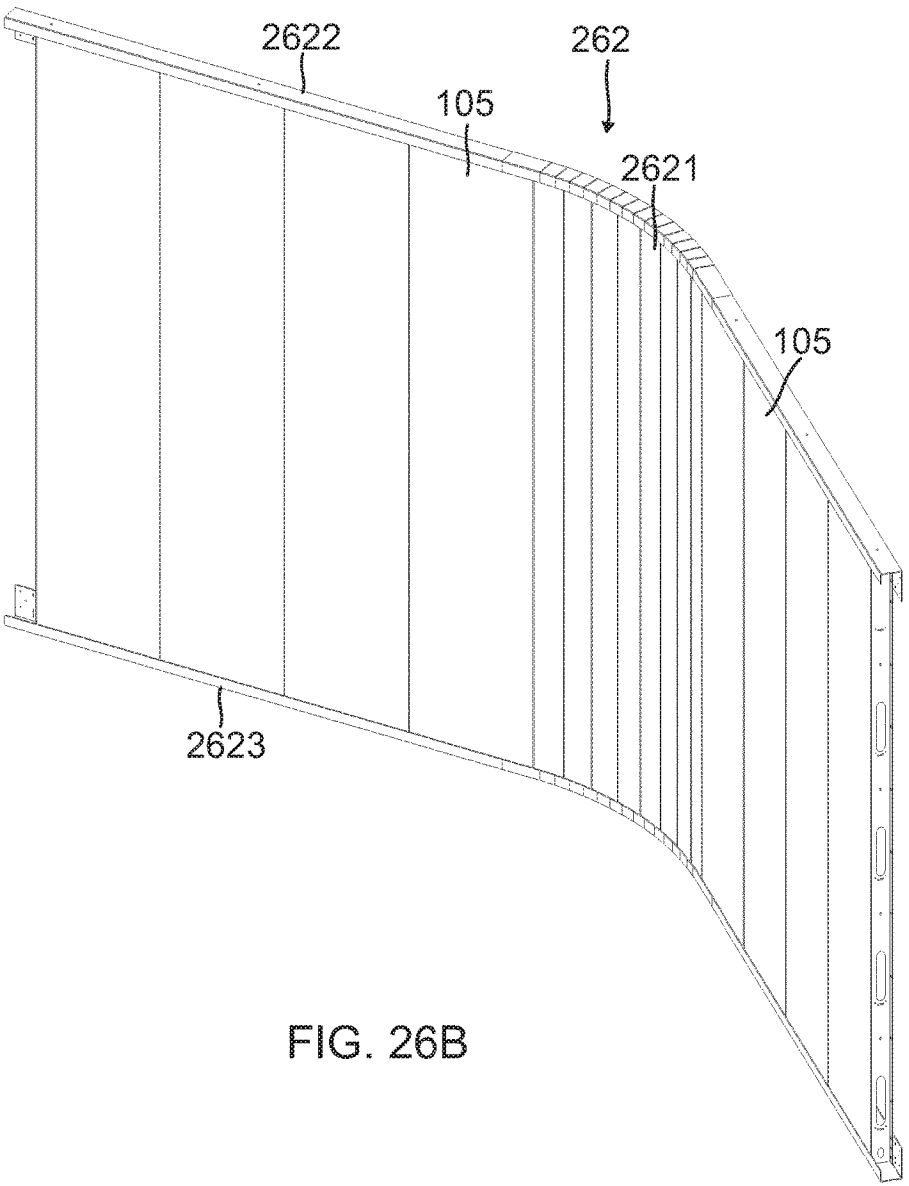
FIG. 26B is a perspective internal view of two wall segments connected in a curve of greater than a 90° angle.

For an inside curved wall section, rail 2613 can be bent inwardly until all the wedges are opened up, as shown in FIG. 26B.

It is often desired to have one or more windows in the wall or room structure formed by the components previously described. An example of a window structure that can accompany the wall kit is shown in FIG. 27.

Figure 27A:
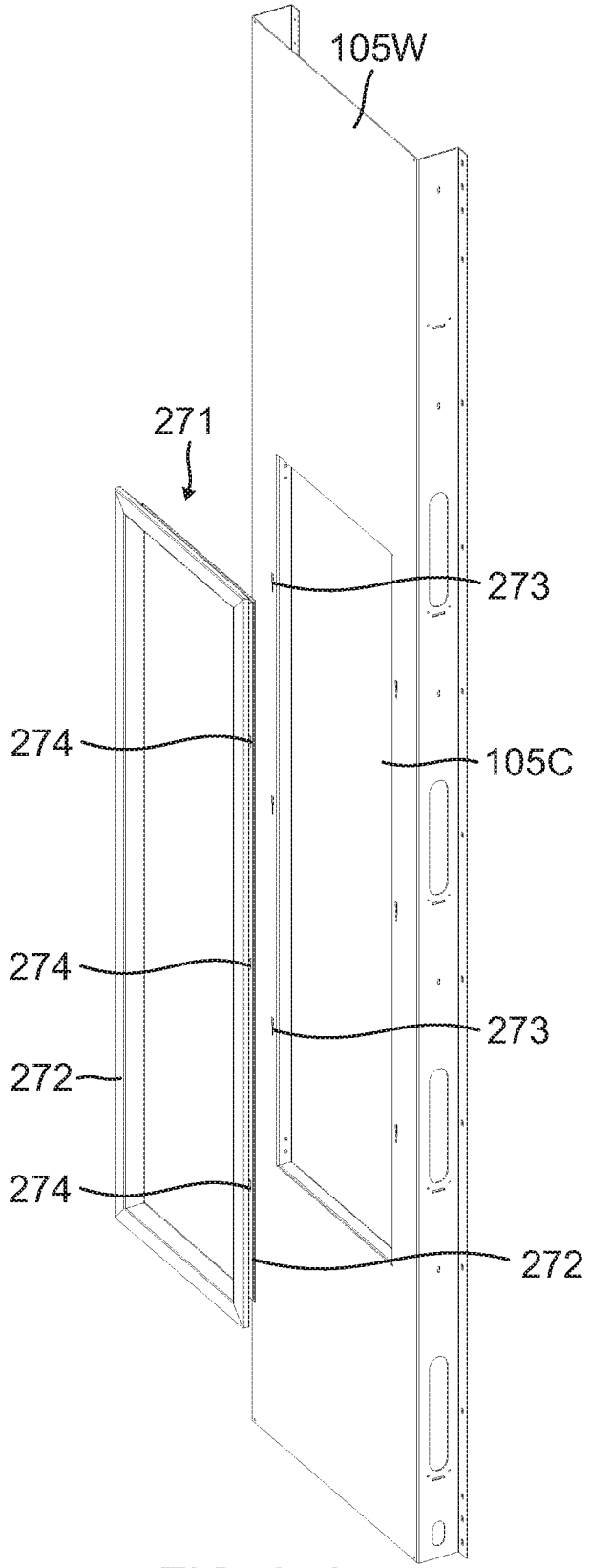
FIG. 27A is a perspective, partially exploded view of a window module configured for use with the wall structure of FIGS. 1 and 2.

A single window panel 105W is shown in FIG. 27A. Except for the window opening 105C, panel 105W can otherwise be a wall panel 105 as shown in FIG. 1. As shown in FIG. 27A, a window unit 271 has a frame with side trims or frame elements 272 having hooks 274 (not clearly shown in this figure) of the type shown with interior finish panels in FIG. 8. The inside edges of window opening 105C are formed with cutouts 273, which may be of the type shown in FIG. 7. However, cutouts 273 need not necessarily be trapezoidal but could be simple slots to receive the hooks on the window trim elements. A single panel 105W with a basic width window unit 271 is shown in FIG. 27B.

Figure 27D:
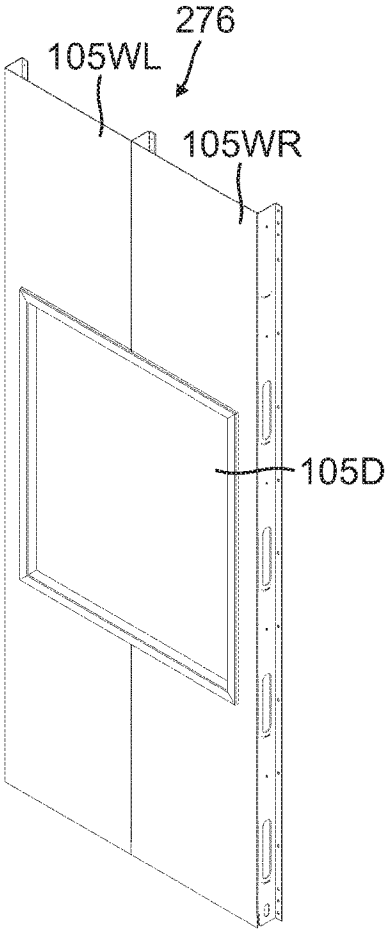
FIG. 27D is a perspective view of a double-wide window module with frame trim in the opening of FIG. 27C.
Figure 27C:
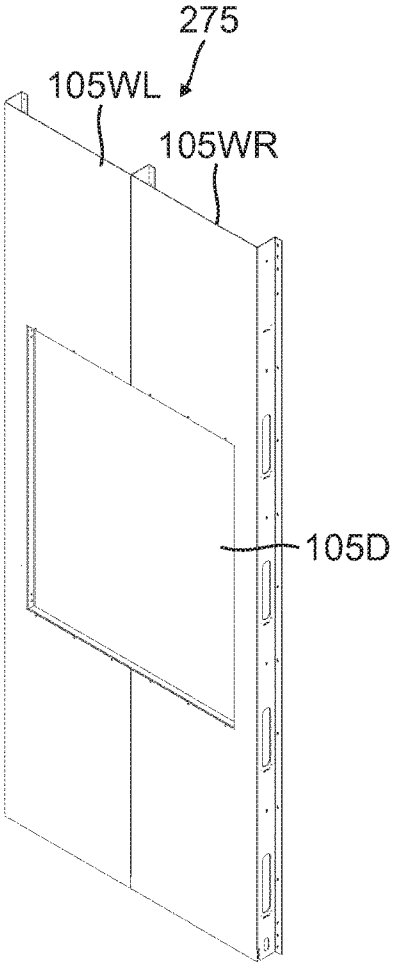
FIG. 27C is a perspective view of a double-wide window opening in wall panels of the wall structure of FIGS. 1 and 2.
Figure 27B:
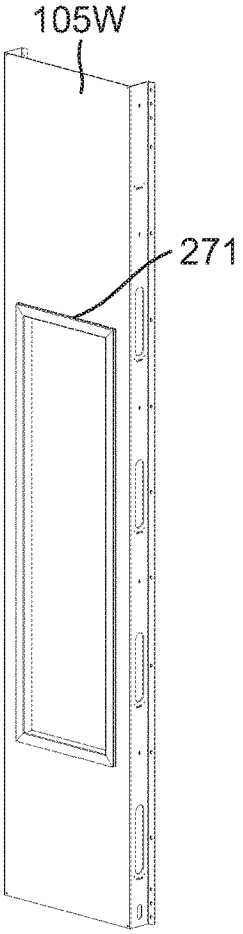
FIG. 27B is a perspective view of the assembled window module of FIG. 27A, with frame trim.

FIGS. 27C and 27D show dual-width window units 275, without trim, and 276 with trim. Left wall panel 105WL and right wall panel 105WR are mated as shown, so that the two panels form window opening 105D.

In most cases, a modular wall or room constructed in accordance with this disclosure will require a door. Doors may be of different widths and they may be single or double doors. They may be provided to the end user as a pre-assembled kit or they may be assembled on site.

Figure 28:
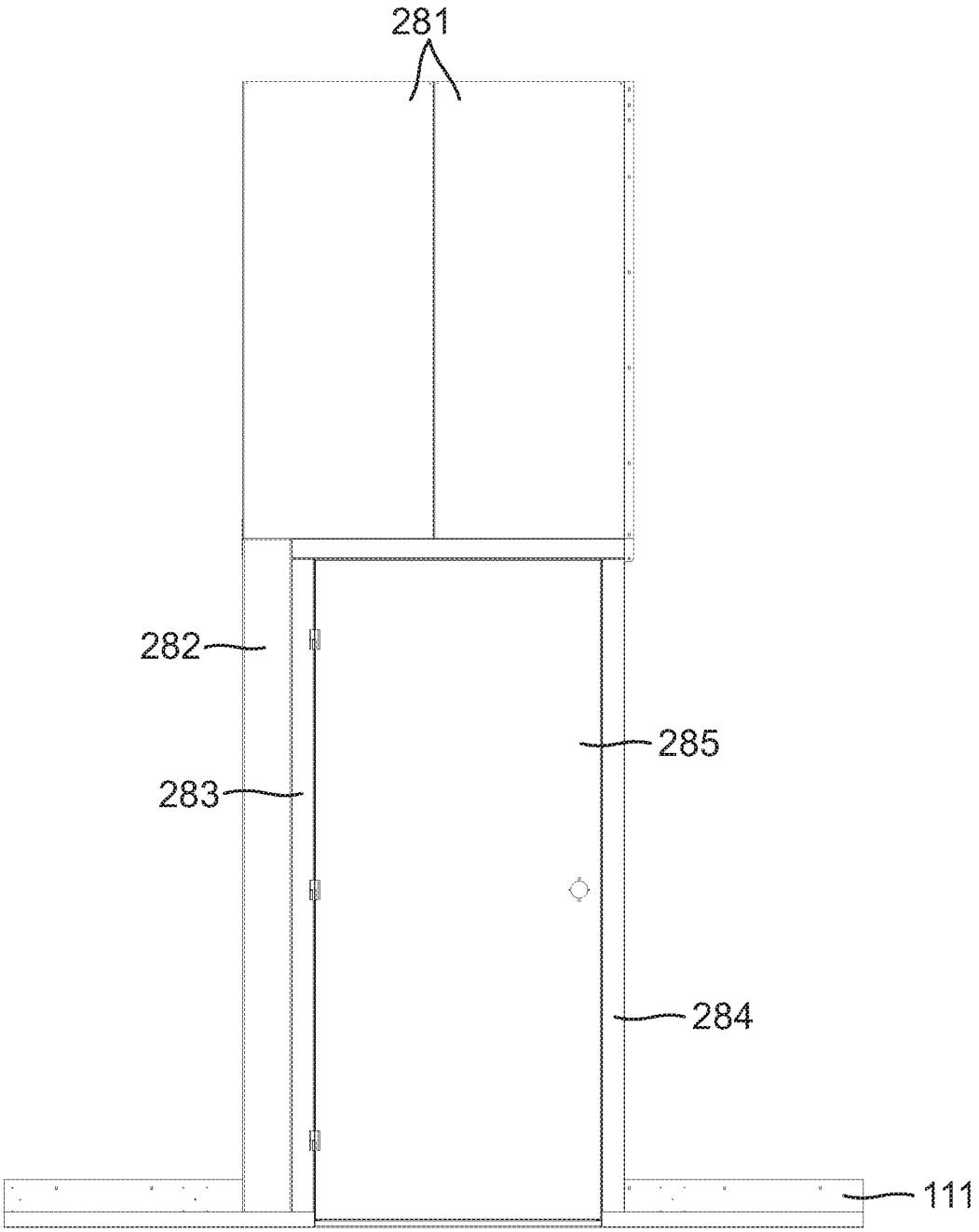
FIG. 28 is a front view of a door module showing a single door configured for use with the wall structure of FIGS. 1 and 2.

A single door configuration is shown in FIG. 28. Upper shortened wall panels 281 could be of a basic width of 24 inches each. Narrow wall panel 282 is connected to hinged door frame element 283 and door latch panel 284 completes the basic door assembly 285. By replacing 283, 284, 285 one can convert the door from a right opening configuration to a left opening configuration. By rotating the door elements 180°, so that the hinges are inside the wall structure and on the opposite side shown in FIG. 28, door 285 can be converted to an inswing arrangement.

Figure 29:
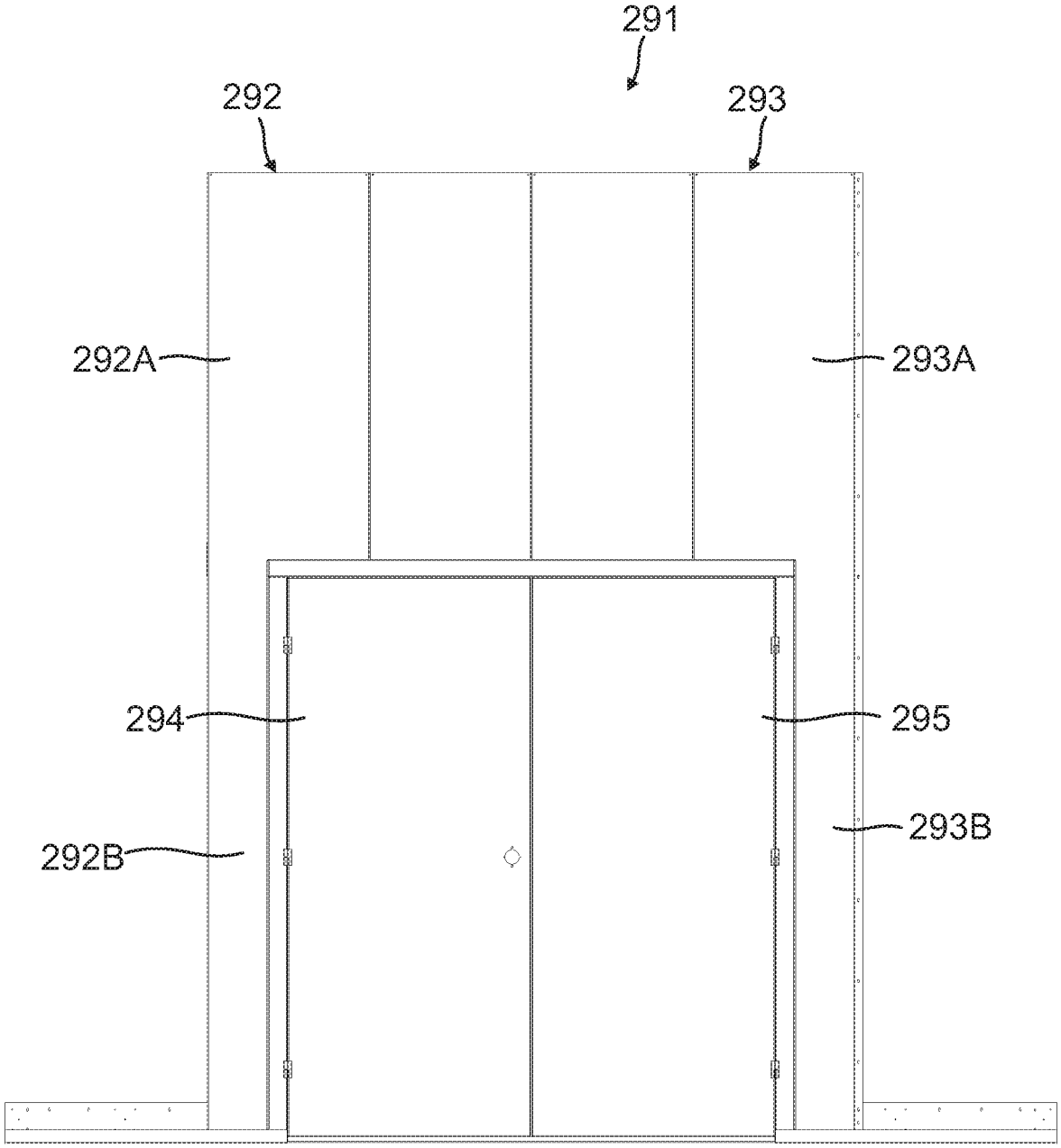
FIG. 29 is a front view of a double door module configured for use with the wall structure of FIGS. 1 and 2.

A double-door structure 291 is shown in FIG. 29. Here, there are right and left full height panels 292 and 293 with full width upper sections 292A and 293A, and narrower lower sections 292B and 293B. In much the same manner as described above with respect to the single door configuration, double doors 294 and 295 are mounted to the wall panels, and they can be outswing or inswing as desired. Of course, the door configurations can range from single and relatively narrow to double door width, without a specifically defined door width. That is, the door opening may be about 36 inches wide or wider, and the double door opening may be as much as 72 inches wide, or even wider.

Figure 30C:
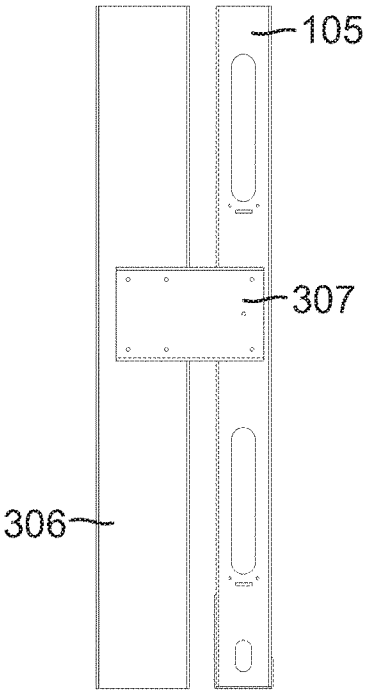
FIG. 30C is an edge view of a stud connected to a wall panel for added stability when wall segments are stacked.
Figure 30B:
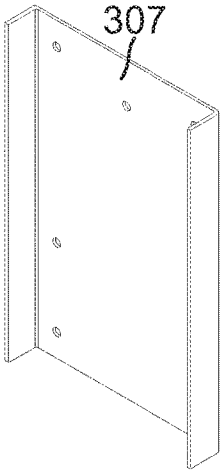
FIG. 30B is a perspective view of stacking brackets which can be used to connect the wall segments to studs, as in FIG. 30C.
Figure 30A:
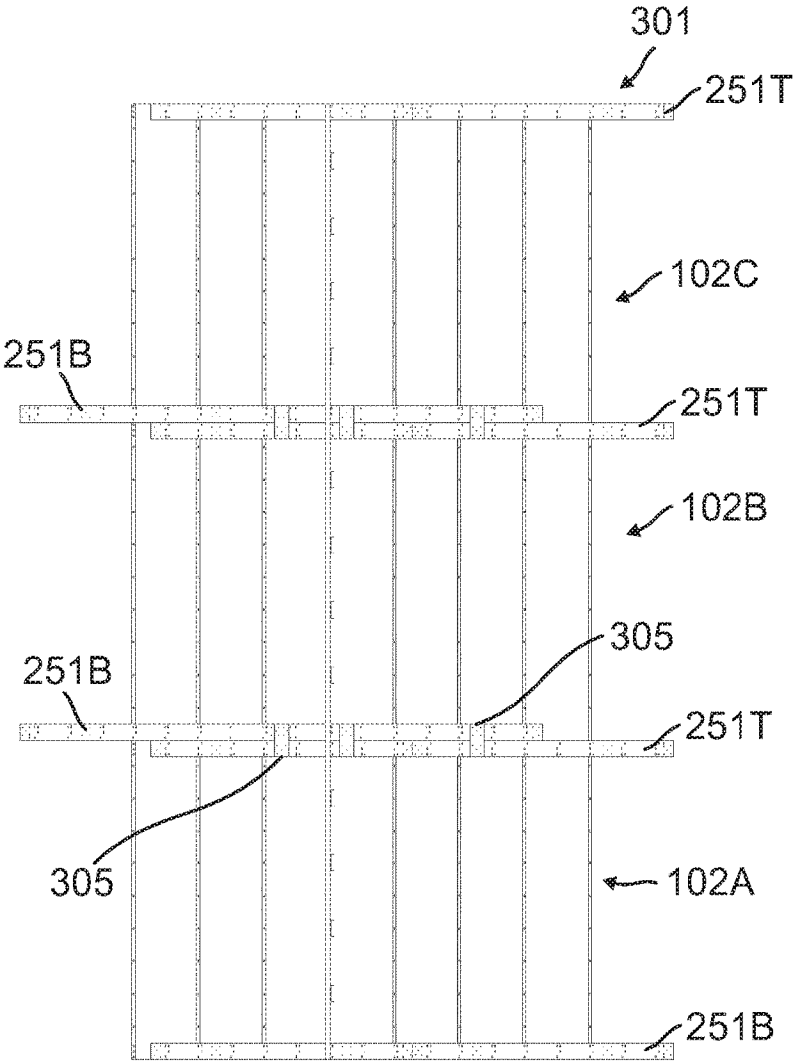
FIG. 30A is a rear or inside view of a wall segment showing how the wall structures of FIGS. 1 and 2 can be stacked when extra height is required.

For higher installations, such as where the roof is higher than is typically the case, the wall panel assemblies of FIG. 1, for example, can be stacked, as shown in FIG. 30. Wall section 102C is shown in FIG. 30A stacked above wall section 102B which is stacked above wall section 102A. Wall section 102A is connected as previously described to bottom rail 251B. A top rail 251T is connected to the top of wall section 102A and a bottom rail 251B, connected to wall section 102B, is secured to top rail 251T of wall section 102A. The same is true for wall section 102C above wall section 102B, thereby forming three-tiered wall structure 301.

Stacking brackets 305 are shown in FIG. 30A. Several of these brackets would normally be used, as shown in FIG. 30A. Bottom rail 251B is the same as top rail 251T, as described with respect to FIG. 25. Connection holes are formed in flange 2511 which match with the holes shown in bracket 305. As many brackets 305 can be used as is deemed necessary for stacked wall rigidity. While all brackets 305 are shown with identical hole patterns, those can vary as necessary for use in the particular locations in connecting the rails together.

For overall stability, studs 306 may be provided, or they could be part of the building structure where a wall assembly is constructed, as shown in FIGS. 30B and 30C. Rail mount 307 can be used to securely connect a wall panel 105 to a stud 306. As many mounts 307 as may be desired can be connected to as many studs 306 as the end user or installer deems necessary for a stable, secure, installation of a stacked wall 301. Stud 306 can have any suitable cross-section and could be made of aluminum or steel and have rigidity as appropriate for the job at hand. It could also be made of wood, a composite, or a strong, rigid plastic.

There may be instances where a top surface or ceiling is desired for a room or partial room formed by the parts described herein. A structure for adding ceiling beams is shown in FIG. 31.

Figure 31A:
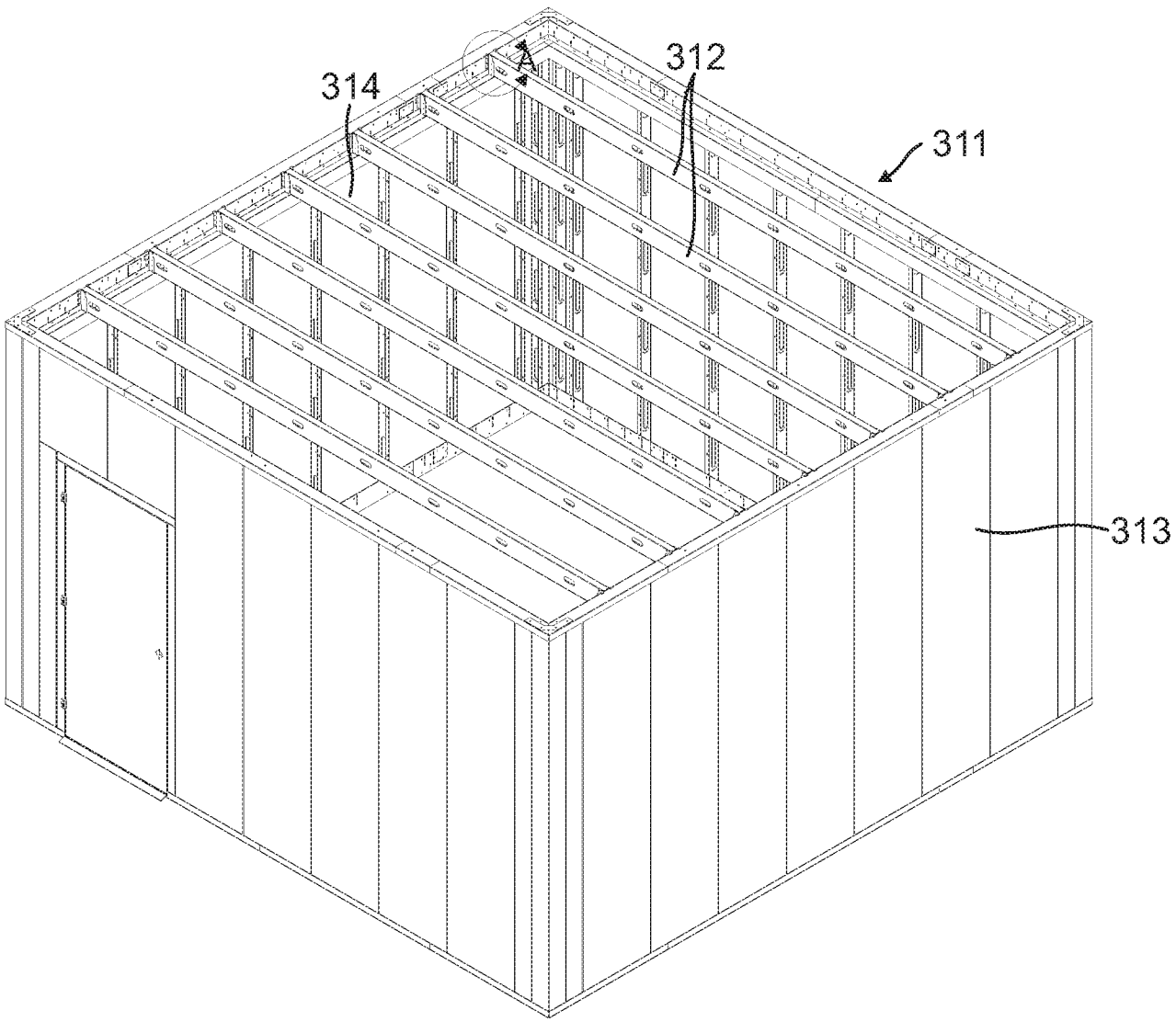
FIG. 31A is a perspective top view of a room constructed in accordance with embodiments of the present invention, showing top or ceiling beams in place.
Figure 31C:
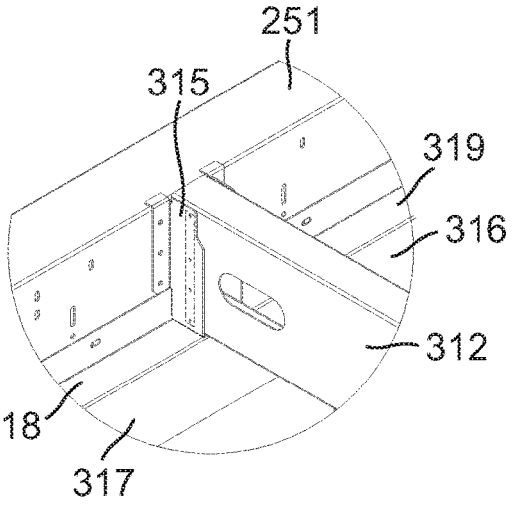
FIG. 31C is a fragmentary perspective view of the wall beam, and beam support bracket taken at detail C in FIG. 31A.
Figure 31B:
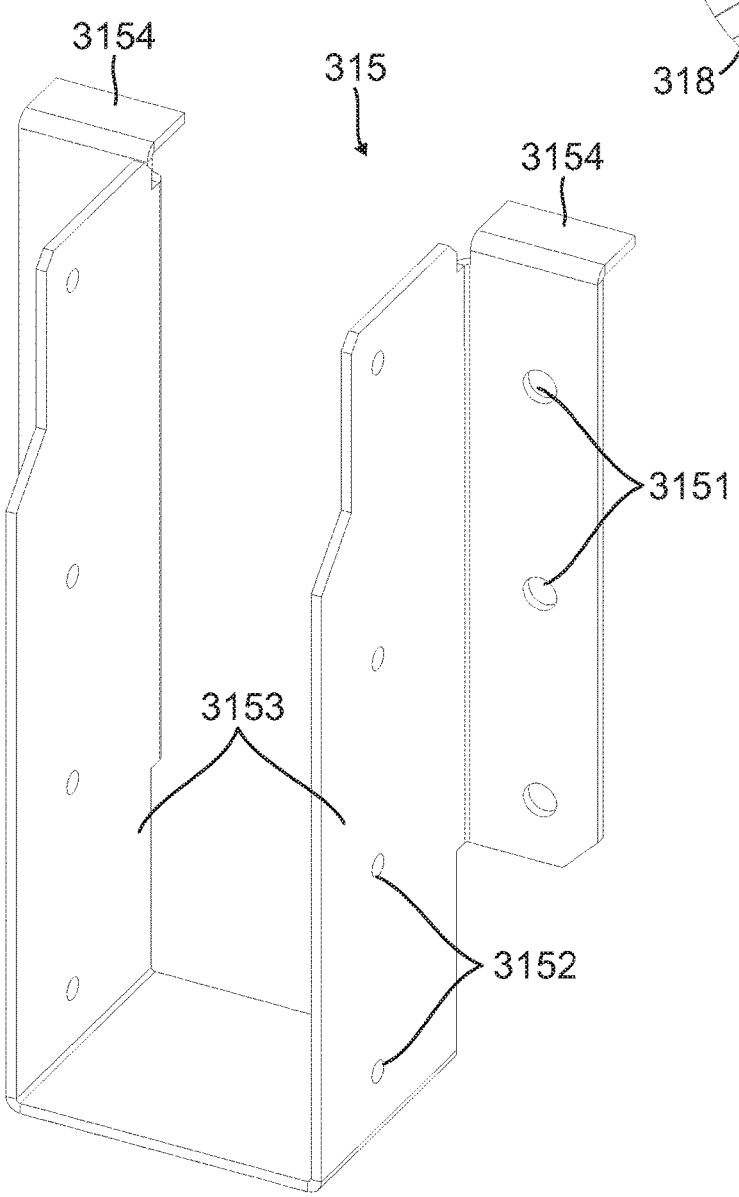
FIG. 31B is a perspective view of beam support bracket used in the FIG. 31A structure.
Figure 31D:
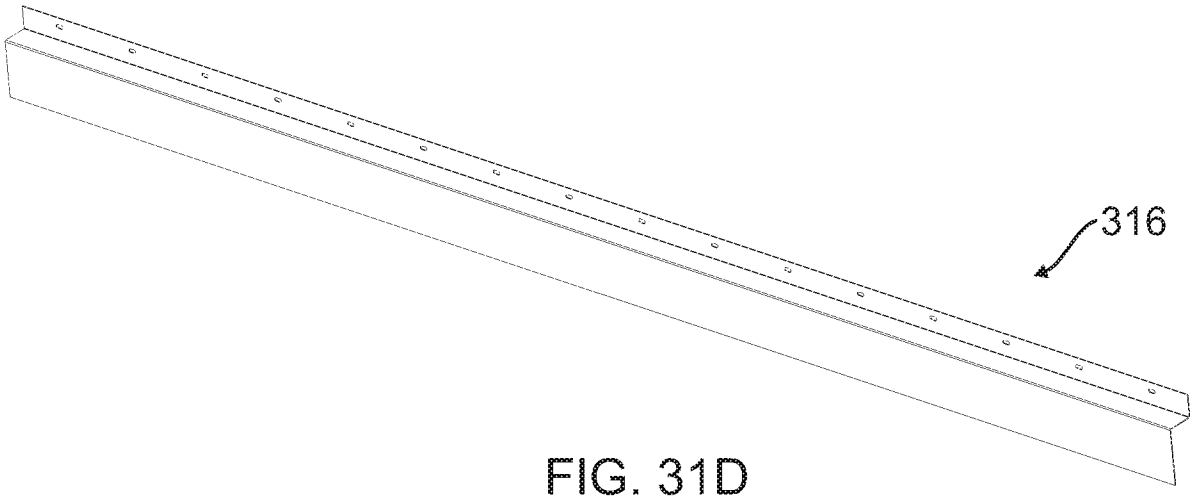
FIG. 31D is a perspective view of a moulding trim cap shown as used in FIG. 31C.

FIG. 31A shows a completed room 311 with T-bar ceiling beams 312 mounted across walls 313 and 314. Beam support bracket 315 is shown in FIG. 31B and in a partial view in FIG. 31C a beam is shown connected to the wall structure by using bracket 315. The support brackets are secured by suitable devices such as metal screws or bolts to moulding trim cap 316, shown in detail in FIGS. 31D and 31E.

Figure 31E:
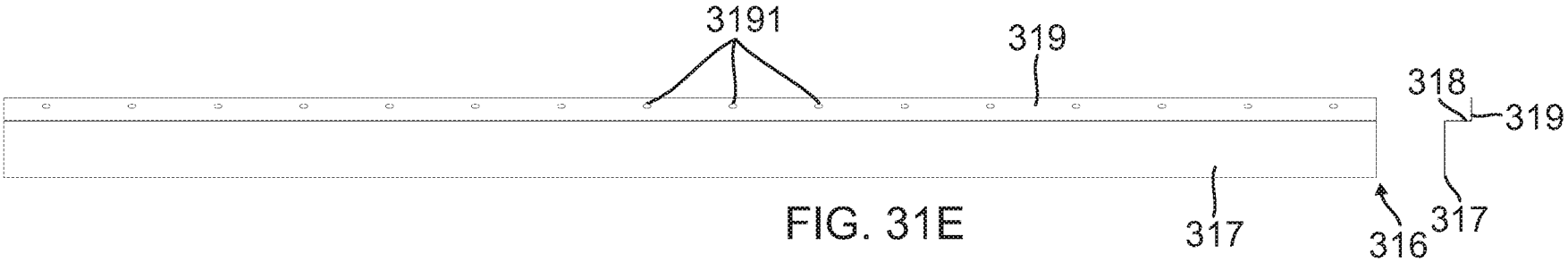
FIG. 31E is a front and end view of the trim cap of FIG. 31D.

Moulding trim cap 316 is Z-shaped in the end view shown in FIG. 31E. Trim cap 316 has a vertical panel 317, a transitional flange 318, and a vertical flange 319. Holes or slots 3191 are used to secure trim cap 316 to a top rail, such as rail 113 or 251, shown in FIGS. 1 and 25.

Bracket 315 has holes 3151 for connecting the bracket to top rail 251, and holes 3152 in side walls 3153. Lips 3154 add to the rigidity of the ceiling beams and walls connections for connecting to beam 312.

FIG. 31 shows only one example of a ceiling support structure. Of course, ceiling panels, such as acoustic panels, may be mounted to beams 312 in a conventional manner. Beams 312 could have any cross section, not necessarily T-bar. If they were rigid plastic, the beams could be solid or hollow, square or rectangular. They could be L-beams, or I-beams, or have any other cross section.

Further, brackets 315 could be formed without lips 3154 so they could be mounted directly to a building wall, or to beams or panels attached to the building wall. If brackets 315 are mounted to an element attached to the building wall, lips 3154 could still be part of the bracket.

This allows the ceiling support structure to extend between a single wall such as front section 102 (FIG. 1) and a building wall, or from a two-segment wall structure, such as front section 102 and side section, 103 or 104, to a building wall. If the wall structure consists of three sides, as shown in FIGS. 1 and 2, the beams of the ceiling support structure can extend from the middle wall section to the building wall, or between the two sides or wing sections 103 and 104.

The panels and other components and elements of this system are preferably made of metal. More particularly, the metal parts are preferably made with recyclable steel or aluminum. The panels are preferably powder coated. The preferred powder coating is mold resistant and provides a finish which can withstand nearly all elements, as well as being flame and corrosion resistant. The powder coating can also be antimicrobial and anti-graffiti.

As a matter of convenience, any one or more wall panels 105 can be separately removed and replaced. Such replacement might be desired in order to add a window, or a door assembly, or to use a different wall panel for any number of possible reasons.

The invention claimed is:

1. A modular panel and component system from which a variety of structures with shapes characteristic of wall segments and enclosures may be rapidly assembled, the system comprising:

a plurality of elongated wall panels having rearwardly projecting flanges along the edges of the wall panels;

a plurality of elongated interior finish panel rails, each said interior finish panel rail having a plurality of tapered cutouts having a first length;

a plurality of elongated interior finish panels, each having a finish surface and a flange projecting rearwardly away from the finish surface along each edge of the finish panel, each flange having a plurality of hook elements projecting rearwardly away from the finish surface, each said hook having a length which is less than the first length of said cutout; and a multiplicity of connecting elements for connecting adjacent rearwardly projecting flanges of adjacent elongated wall panels and for connecting the interior finish panel rails to said wall panels.

2. The system of claim 1, wherein said interior finish panel rails are configured to be connected to said wall panels in parallel therewith.

3. The system of claim 1, wherein said tapered cutouts are oriented co-linearly with the elongation of said interior finish panel rails.

4. The system of claim 1, and further comprising at least one elongated starter panel by which an end wall panel is configured to be attached to a building wall, said at least one starter panel having a plurality of tapered cutouts having a first length which is co-linear with the elongation of said starter panel.

5. The system of claim 1, and further comprising a bottom rail formed to receive bottom edges of a plurality of adjacent wall panels, said bottom rail having at least a portion being further configured to form a curve, whereby adjacent wall panels secured to said curved bottom rail portion forms a curved wall segment.

6. The system of claim 1, and further comprising a top rail formed to receive top edges of a plurality of adjacent wall panels, said top rail having at least a portion being further configured to form a curve, whereby adjacent wall panels secured to said curved top rail portion forms a curved wall segment.

7. The system of claim 1, and further comprising:

a bottom rail formed to receive bottom edges of a plurality of adjacent wall panels;

a top rail formed to receive top edges of the said plurality of adjacent wall panels; and said bottom rail being connectable to said top rail to form a vertical stack of wall segments or enclosures.

8. The system of claim 1, and further comprising:

a plurality of beam support brackets mountable to the top of two spaced opposite wall segments; and a plurality of beams mountable to said plurality of beam support brackets to support a roof or ceiling over the spaced opposite wall segments.

9. The system of claim 1, and further comprising a window module connectable to wall panels formed with an opening to accept a said window module.

10. The system of claim 9, wherein said window module comprises a frame configured with rearwardly projecting hooks, said opening having edges formed with slots to receive said hooks from said window module frame.

11. The system of claim 10, wherein said door module comprises a single door.

12. The system of claim 10, wherein said door module comprises a double door.

13. The system of claim 1, and further comprising a door module assembly configured to connect to adjacent wall panels.

* * * * *